United States Patent [19]

Sainio

[11] Patent Number: 4,887,530

[45] Date of Patent: Dec. 19, 1989

[54] WEB REGISTRATION CONTROL SYSTEM

[75] Inventor: Jeffrey W. Sainio, Hartland, Wis.

[73] Assignee: Quad/Tech, Inc., Pewaukee, Wis.

[21] Appl. No.: 849,095

[22] Filed: Apr. 7, 1986

[51] Int. Cl.[4] ..... B41F 5/06

[52] U.S. Cl. ..... 101/181; 101/486

[58] Field of Search ..... 101/181, 248, DIG. 12, 101/211, 426, 485, 486; 226/2, 3, 27, 28, 29, 24, 30–33, 15–18, 45; 250/548, 559, 561, 557, 571, 226

[56] References Cited

U.S. PATENT DOCUMENTS

| | | | |
|---|---|---|---|
| 2,576,529 | 11/1951 | McKenney et al. | 101/181 X |
| 3,915,090 | 10/1975 | Horst et al. | 101/426 |
| 4,278,893 | 7/1981 | Kato et al. | 250/548 |
| 4,528,630 | 7/1985 | Sargent | 226/30 |
| 4,532,596 | 7/1985 | Pugsley | 364/469 |
| 4,552,608 | 11/1985 | Hoffman | 226/30 |
| 4,561,103 | 12/1985 | Horiguchi . | |
| 4,578,590 | 3/1986 | Wu | 250/548 |
| 4,719,575 | 1/1988 | Gneuchtel | 364/469 |

FOREIGN PATENT DOCUMENTS

| | | | |
|---|---|---|---|
| 0079153 | 5/1983 | European Pat. Off. . | |
| 123305 | 10/1984 | European Pat. Off. | 101/181 |
| 1075199 | 2/1960 | Fed. Rep. of Germany . | |
| 1292420 | 4/1969 | Fed. Rep. of Germany . | |
| 2344819 | 1/1975 | Fed. Rep. of Germany . | |
| 2643481 | 3/1978 | Fed. Rep. of Germany . | |
| 1041804 | 10/1953 | France . | |
| 0205766 | 11/1983 | Japan . | |

OTHER PUBLICATIONS

Descriptive brochure entitled "Register Guidance System III from Quad/Tech, Fully Automatic Register, Control", produced by Quad/Tech.

Descriptive brochure entitled "Quad/Tech Register Guidance System III", produced by Quad/Tech, Quad/Tech, Duplainville Rd., Pewaukee, Wis.

*Primary Examiner*—J. Reed Fisher

*Attorney, Agent, or Firm*—Foley & Lardner

[57] ABSTRACT

A system for generating indicia of registration error between the respective printing units of a web-fed, four-color printing press. An optical line scanner is disposed over a web to generate signals indicative of the brightness level of successive nominal pixels along a line transverse to the motion of the web. The respective printing units each generate registration marks on the web, the relative positions of which are indicative of the relative cyclical (rotational) and transverse (lateral) positions of the printing units with respect to the web. As the web moves past the scanners, successive line scans generated by the scanner provide the equivalent of a two-dimensional raster scan of a strip of the web centered on the expected center line of registration marks produced by the respective printing units. The centers of the respective registration marks are determined, and the cyclical (rotational) and transverse (lateral) positions of the printing unit adjusted, in accordance with deviations from expected relative positions. The use of symmetrical marks and, in particular, right-angled diamonds, is disclosed for facilitating calculation of the center of the marks.

42 Claims, 21 Drawing Sheets

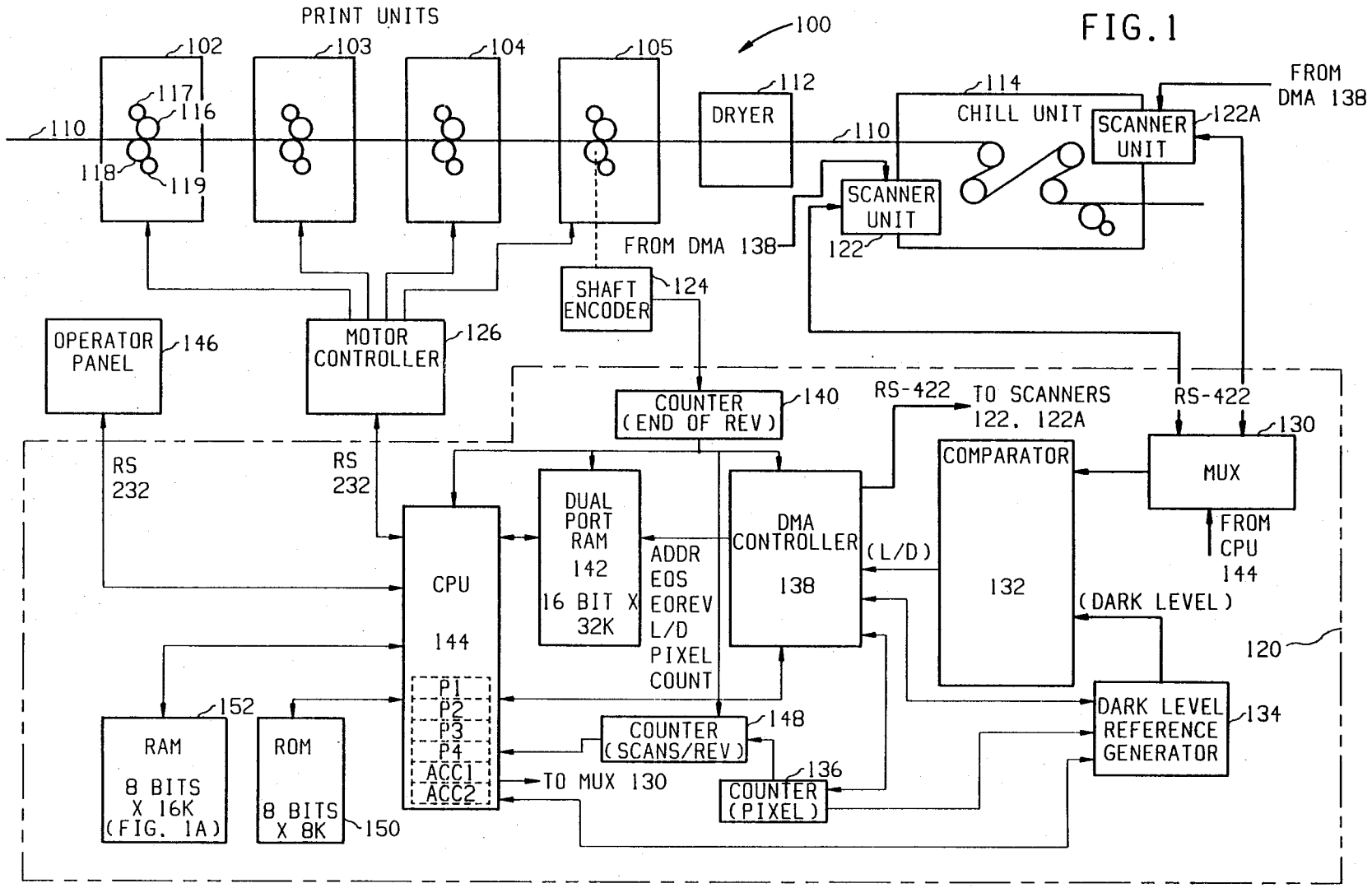
FIG. 1
100
FROM DMA 138
122A
SCANNER UNIT
CHILL UNIT
114
SCANNER UNIT
122
110
DRYER
112
FROM DMA 138
105
104
103
102
PRINT UNITS
117
116
119
118
110
124
SHAFT ENCODER
126
MOTOR CONTROLLER
146
OPERATOR PANEL
RS 232
RS 232
RS-422
130
MUX
FROM CPU 144
120
134
DARK LEVEL REFERENCE GENERATOR
(DARK LEVEL)
COMPARATOR
132
TO SCANNERS 122, 122A
RS-422
(L/D)
140
COUNTER (END OF REV)
DMA CONTROLLER
138
136
COUNTER (PIXEL)
148
COUNTER (SCANS/REV)
ADDR
EOS
EOREV
L/D
PIXEL COUNT
DUAL PORT RAM 142
16 BIT X 32K
TO MUX 130
CPU
144
P1
P2
P3
P4
ACC1
ACC2
150
ROM
8 BITS X 8K
152
RAM
8 BITS X 16K (FIG. 1A)

SCANNER CIRCUIT

XFER PULSE SYNCHRONIZER

VIDEO TO ADC
ADC DRIVER
47
C5 .1MFD 50V
+12v
BUFFER 312
Q4 2N2222
8-9v VIDEO
380
R10 1K
R11 1K
LINE SCANNER
Q6 2N2907
318
C17 22PF 100V
R25 10K
-5v
R12 1K
C16 22PF 100V
Q5 316
LEVEL SHIFTER
2N2222
R26 100K
R22 270
R20 ????
C7 .1MFD 50V
-5v
VDD VCD VCD VDD VT VT VEI VPG X T SHCA SHGA SHCB SHGB VSS
CCD153 VIDOUTA VIDOUTB EOSOUT
300
+12v
750 1K
BIAS
680 ????
C4 .1MFD 50V
CCD DRIVER
+12v
START SCAN
CLOCK
+9V BIAS
C6 .1MFD 50V
620 ????
820 470
+12v
C15 .1MFD 50V
D1 1N5223 2.7V
+5v
310
VDD OUTA OUTB E*1 E*2 OUTC OUTD
VCC INA* INB* C* R* INC* IND* GND
9645 IC23
308B
+5V
308A
+12V

WEB REGISTRATION CONTROL SYSTEM

BACKGROUND OF THE INVENTION

The present invention relates to control systems for adjusting the color-to-color registration of multicolor web-fed printing press systems.

In multicolor web-fed printing press systems, a web of material (e.g., paper) is sequentially driven through a series of print cylinders, each using ink of a different color, which cooperate to imprint a multicolor image on the web. To provide an accurate and clear multicolor image, the rotational and lateral position of each print cylinder must be precisely aligned, i.e., proper registration of the respective colors must be maintained.

Historically, the registration of the various print cylinders in multicolor systems was maintained manually. A pressman would examine signatures (printed images) at the output of the press, and manually enter estimated lateral and rotational offset values into an electromechanical register control system to effect necessary corrections. Retention of color registration in such systems requires the constant attention of the pressman since registration is often lost due to a number of uncontrollable variables in the web material and press hardware.

Automatic registration control systems for multicolor web-fed printing press systems are, in general, known. An example of a closed-loop register control system is the commercially available Quad/Tech RGSIII register control system, a product of the assignee of the present invention. The RGSIII system utilizes a single photosensor cooperating with register marks printed on the web by the individual cylinders to provide position feedback information indicative of the registration of the respective print cylinders relative to a designated reference print cylinder. More particularly, each print cylinder produces a specific register mark forming part of a register pattern. The photosensor provides a feedback signal indicative of the register pattern, which is analyzed to determine the lateral and rotational registration of the respective print cylinders vis-a-vis the reference cylinder. Registration error signals are produced for the respective print cylinders and are employed to effect position correction.

Each register mark in the RGSIII system comprises two triangular sections disposed, if properly aligned, to produce two voltage pulses of equal time duration. The photosensor is positioned to focus at the center of the register pattern. As paper motion takes the pattern past the scanner, a series of voltage pulses are produced. To track any lateral movement of the web, the duration of the respective pulses generated by the marks is monitored; if the focal point of the scanner is not centered, the two pulses produced by the respective triangular sections of the mark will not be of equal duration. When such a condition is sensed, the system generates control signals to reposition the printing cylinder to center the pattern. If the printing cylinder associated with a mark is rotationally out of registration, the register mark produced will not be properly aligned in the register pattern, and the two voltage pulses produced by the register mark will be advanced or delayed relative to the pulses produced by the register marks associated with the other cylinders. Deviations from predetermined values of the position of the center points of the register marks relative to a pattern reference point are detected and control signals generated accordingly.

Previous automatic registration control systems, which utilize only a single photosensor scanner, scan a single straight line as the paper travels under the focal point of the sensor. This requires the register marks to be sufficiently wide to be sensed by the scanner in worst-register situations, often at least 0.2 inch total on width. Moreover, web "weave" (spurious lateral movement of the web) tends to require that a still wider registration mark be employed. This is disadvantageous; it is desirable that the registration mark be as small and unobtrusive as possible.

Prior art registration control systems using a single triangle registration mark are additionally disadvantageous in that variations in the density of the inks can often be erroneously perceived by such systems as registration errors.

SUMMARY OF THE INVENTION

The present invention provides a closed-loop register control system employing an optical line scanner which cooperates with paper movement to provide, in effect, a two-dimensional raster scan of a predetermined portion of the web on which registration marks are imprinted by the respective print cylinders. Register marks anywhere within the scan can be viewed. Accordingly, smaller, less obtrusive registration marks can be employed than has historically been the case.

In accordance with another aspect of the present invention, diamond-shaped registration marks are utilized in cooperation with the optical line scanner to provide effective operation at high press speed and eliminate errors due to colorimetry changes.

BRIEF DESCRIPTION OF THE DRAWING

A preferred exemplary embodiment of the present invention will hereinafter be described in conjunction with the appended drawings where like numerals denote like elements and:

FIG. 1 is a functional block diagram of printing system in accordance with the present invention;

In FIGS. 5–13, a shorthand convention has been adopted whereby: the symbol "[ ]" means "the contents of", e.g., "[x]" means the contents of register x; the name of a memory device or table followed by a parenthetical suffix, e.g., RAM 142(pl), refers to the particular location of the RAM designated by the address contained in the parentheses, e.g., P1; and the symbol "→" means "loaded into". For example, [RAM142(P2)]→RAM152(P1) means "the contents of the location in RAM 142 designated by the contents of pointer P2 is loaded into the location in RAM 152 designated by the contents of pointer P1.

DETAILED DESCRIPTION OF A PREFERRED EXEMPLARY EMBODIMENT

Figure 1A:
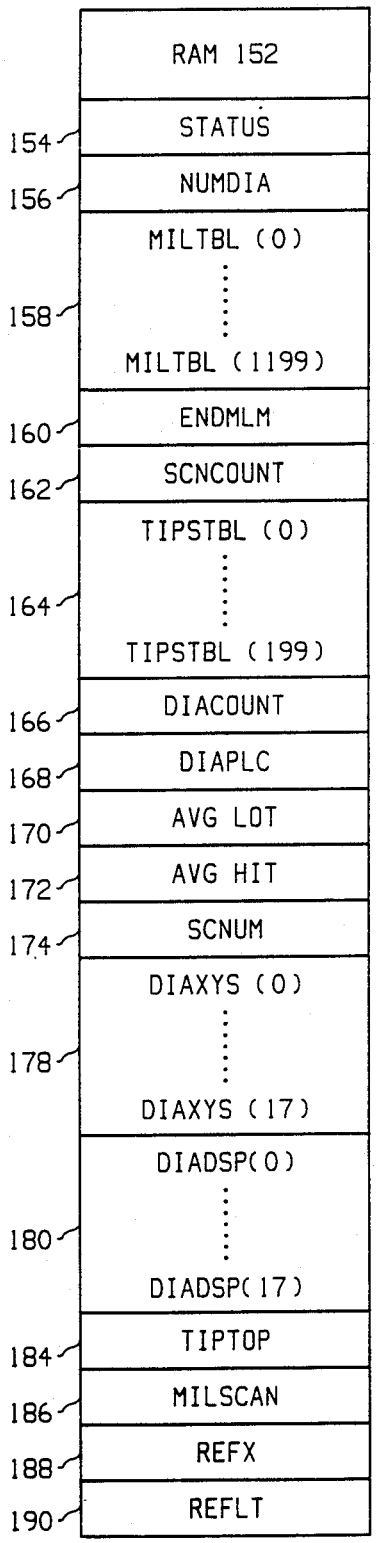
FIG. 1A is a schematic representation of the contents of random access memory 152 of FIG. 1.

Referring now to FIG. 1, a web-fed printing system 100 employing the registration control system of the present invention is preferably comprised of serially-disposed conventional printing units 102–105 operating upon a driven web 110. In a web offset printing press, each of printing units 102–105 advantageously includes an upper blanket cylinder 116, an upper plate cylinder 117, a lower blanket cylinder 118 and a lower plate cylinder 119.

Web 110, typically paper, is fed from a reel stand (not shown) through the successive printing units 102–105 and thereafter through a dryer unit 112 and chill unit 114. Web 110 is then suitably guided through coating equipment (not shown) and folding equipment (not shown) which folds and separates the web into individual signatures.

Printing units 102–105 cooperate to imprint multicolor images on the upper and lower surfaces of web 110. Each printing unit 102–105 prints in an associated color of ink; typically the first sequential print unit 102 suitably prints the color black, and the subsequent print units 103–105 print other colors such as cyan, magenta, and yellow. Each of the lateral and rotational positions of upper and lower plate cylinders 117, 119 is separately controlled by suitable adjustment mechanism, e.g., electric motors (not shown) to precisely adjust the registry of the respective images generated by the individual printing units.

A registration control system in accordance with the present invention comprises a processor 120, cooperating with optical line scanning units 122 and 122A, a conventional shaft encoder 124 and a suitable motor controller 126. As will hereinafter be explained, a registration control system in accordance with the present invention generates control signals to the adjustment mechanism in accordance with the relative positions of the registration marks; it provides appropriate signals to the electric motors to precisely control lateral and rotational position of the plate cylinders.

Figure 2:
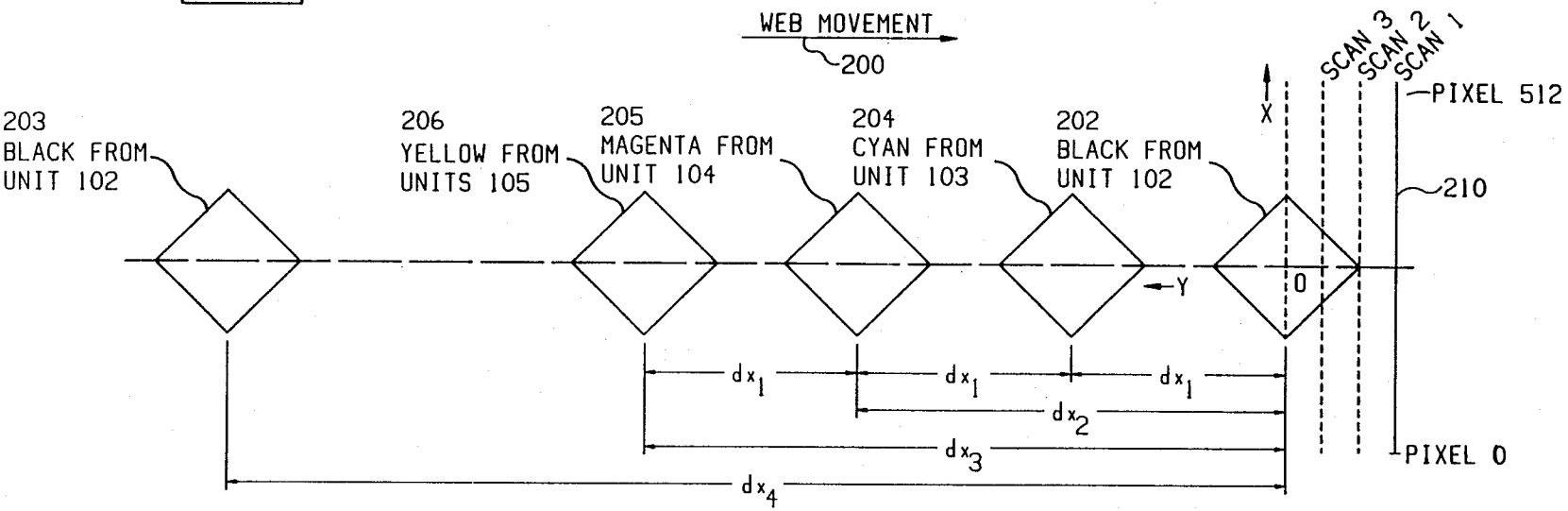
FIG. 2 is an illustration of a preferred registration mark and nominal scan lines.

Each of printing units 102–105 imprints at least one registration mark of a predetermined size and shape on a predetermined portion of web 110, typically along its edge. Referring briefly to FIG. 2, when in proper registry, the marks from the individual print units 102–105 will be in predetermined relative disposition on web 110, suitably spaced at regular predetermined intervals, e.g. ($d_{xi}$), along a straight line in the direction of web movement (indicated by arrow 200). Preferrably, at least one of the plate cylinders on each side of web 110 imprints a plurality of register marks at predetermined relative dispositions on the web. For example, plate cylinder 117 of first printing unit 102 desirably prints two black marks 202, 203 on the upper surface of web 110. Adopting a normalized nominal reference coordinate system with a Y axis parallel to the direction of web movement (200) and an X axis parallel to the scan lines, with an origin at the center of mark 202, the centers of marks 202 and 203 are disposed in spaced relationship on a straight line along the Y axis at coordinate (0,0) and ($0,d_{x4}$), respectively. Marks 202 and 203 are suitably the first and last marks in a sequence of marks; plate cylinders 117 of printing units 103–105 print marks 204, 205 and 206 in their associated colors at predetermined regular intervals in the intervening space between black marks 202, 203 ($d_{x4}$). Marks 204–206 are each disposed with centers at coordinates ($0,d_{x1}$), ($0,d_{x2}$) and ($0,d_{x3}$), respectively. Deviation of marks 204–206 from such relative dispositions with mark 202 is indicative of a registration error; deviation from a zero X value is indicative of lateral misregistration, and deviation from the expected Y value is indicative of rotational misregistration. However, since both marks 202 and 203 are from the same cylinder, deviation of mark 203 from the expected disposition (0, $d_{x4}$) is indicative of web skew or stretch rather than registration error. Compensation for web skew and stretch will be explained hereinbelow.

Referring to FIGS. 1 and 2, the portions of the upper and lower surface of web 110 in which registration marks are printed are illuminated by a high-intensity lamp (not shown) such as a tungsten-halogen bulb. Line scanner units 122 and 122A are focused on the illuminated portion of the web.

Line scanner units 122 and 122A generate a sequence of 6-bit digital signals indicative of the brightness level in a predetermined number of successive nominal pixels (hereinafter sometimes referred to as samples, or cells) comprising a line scan.

The line scan, schematically illustrated by line 210 in FIG. 2, is in a direction transverse to the direction of web movement (200) and is of a greater extent than (wider than) the registration marks. As web 110 moves past the scanners, the successive line scans provide the equivalent of a two-dimensional raster scan of the associated areas of web 110, i.e., suitably provide data from a strip of web 110 of predetermined extent, e.g., on the order of one-half inch in width (transverse to the direction of web movement), centered on the expected centerline of the registration marks, and encompassing the marks.

Figure 3:
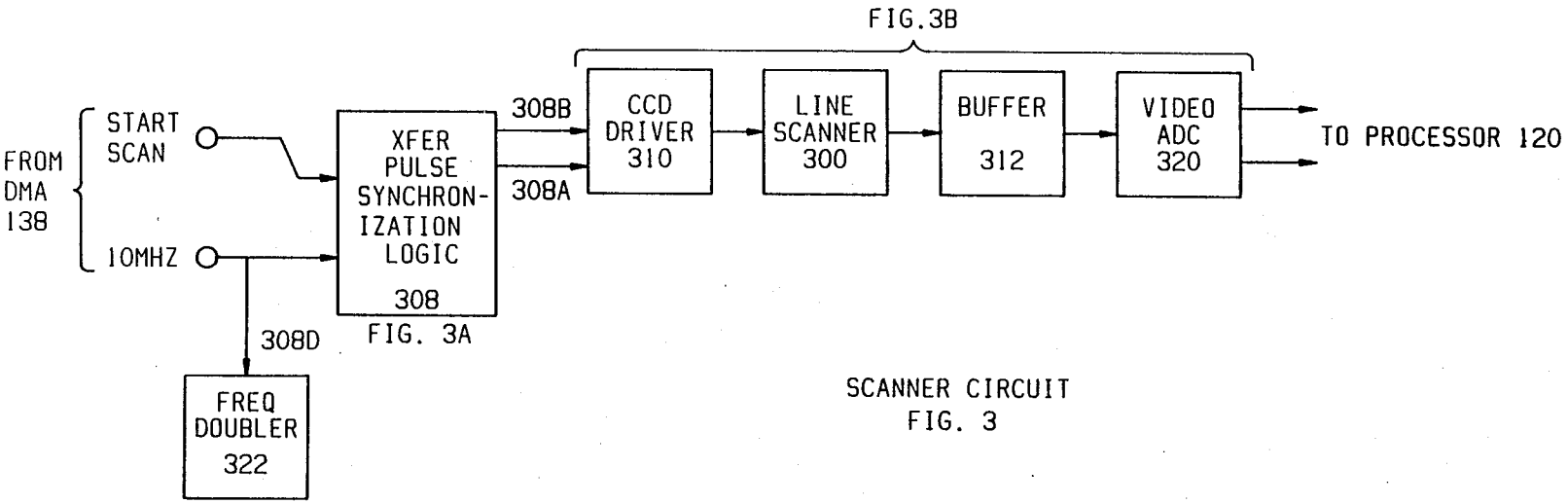
FIGS. 3, 3A and 3B comprise a schematic block diagram of a preferred scanner unit 122 of FIG. 1.
Figure 3A:
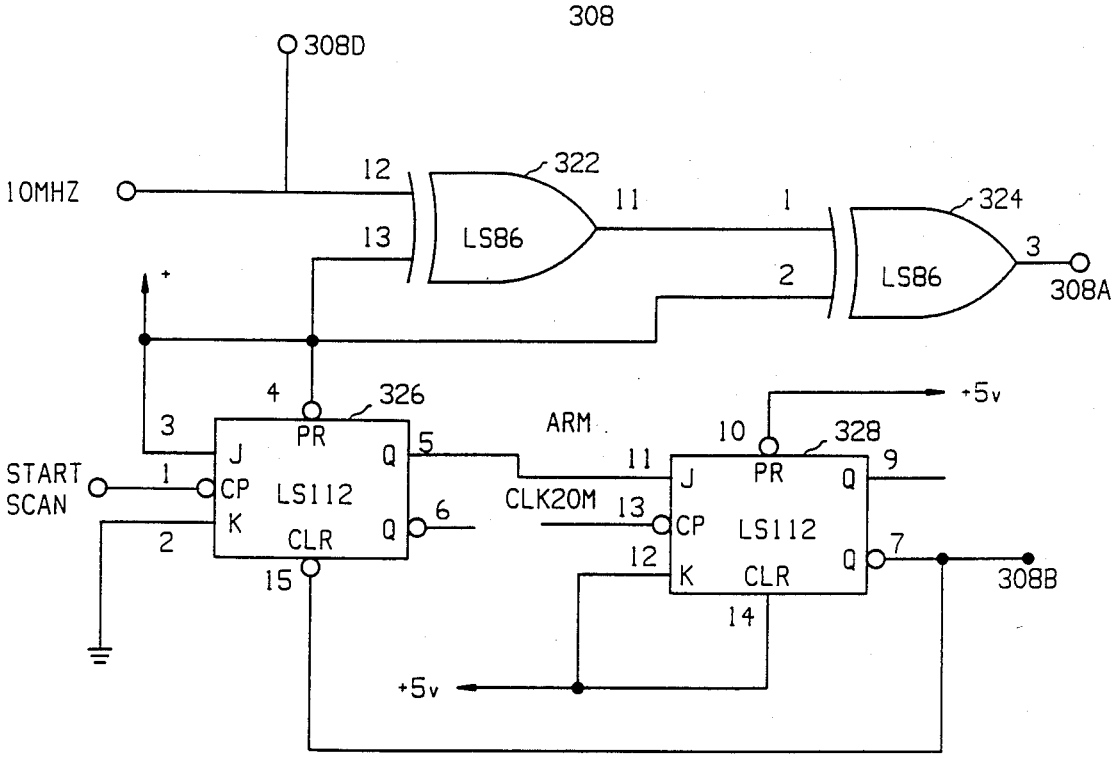
Figure 3B:
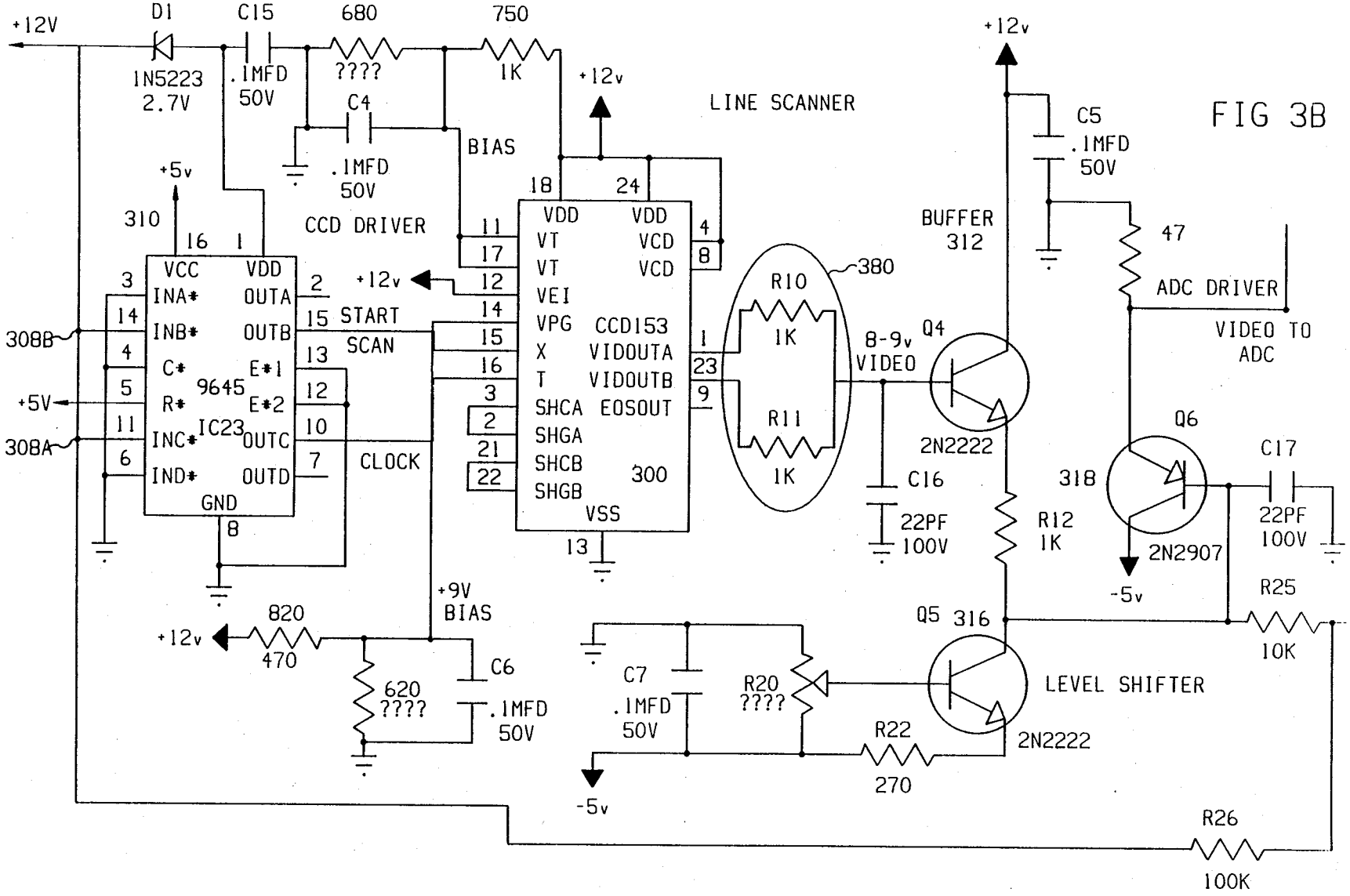

Referring to FIG. 3, scanner units 122 and 122A preferably comprise an optical line scanner, such as a Fairchild CCD153 charge-coupled line image scanner 300, cooperating with suitable circuitry for controllably driving the scanner, such as suitable transfer pulse synchronization logic 308, conventional CCD driver circuitry 310, conventional buffer circuitry 312, and a video analog-to-digital converter 320. More specifically, a start scan signal, and a 10 MHz clock signal from a DMA controller 138 are applied to transfer pulse synchronization logic 308 (preferably through standard RS-422 datalinks, not shown). Transfer pulse synchronization circuit 308 initiates the operation of the scanner in synchronism with the clock signal, e.g., it provides appropriate timing signals to CCD driver 310 and to buffer 312 to synchronize the scanning operation of line scanner 300 and data sampling by buffer 312. Suitable pulse synchronization logic 308 is shown in FIG. 3A. A representative CCD driver 310, line scanner 300 and buffer circuit 312 are shown in FIG. 3B. Specifically, the 10 MHz signal is supplied to a delay line comprising tandem two-input Exclusive OR (ExOR) gates 322 and 324. The output ExOR gate 322 is applied to one input terminal of ExOR gate 324. Both the second inputs of ExOR gates 322 and 324 are tied high. ExOR gates 322 and 324 establish the desired delay and the appropriately delayed 10 MHz signal is provided at output terminal 308A.

The START SCAN signal is applied to the clock input of a JK flip-flop 326, best viewed in FIG. 3A. The J input of flip-flop 326 is tied high and the K input is tied to ground. The Q output of flip-flop 326 is applied to the J input of a JK flip-flop 328; the clock input of flip-flop 328 receives a 20 MHz clock signal; the K and clear inputs of flip-flop 328 are tied high. The Q/ (i.e., Q bar) output is utilized as terminal 308B and is tied back to the clear input of flip-flop 326.

Flip-flops 326 and 328 ensure that the rising edge of the START SCAN signal received by scanners 122 and 122A is coincident with the middle of a high state of the 10 MHz clock signal, irrespective of timing/phase inaccuracies interjected by transmission from processor 120. ExOR gates 322 and 324 compensate the 10 MHz signal for propagation delays of flip-flops 326 and 328. This provides the timing required by the CCD.

Referring to FIG. 3B, the 10 MHz clock signal at terminal 308A and the START SCAN signal at terminal 308B are applied to a conventional CCD driver, such as a Fairchild 9645 CCD driver, for conversion to 12 volt signal levels suitable for driving line scanner 300. Video scanner 300 generates respective even and odd video signals and these are applied to a suitable mixer 330, output signal of which is buffered and level shifted for application to the analog-to-digital converter 320.

Analog-to-digital converter 320 is preferably a TRW TDC 1046 analog-to-digital converter with a 20 MHz clock, fed by line scanner 300 which provides a full 512 pixel image every 26 microseconds. More specifically, scanner 122 effects line scans of 540 pixels in length (i.e., provide image density signals for 540 pixels in sequence). However, various of the pixels are dedicated to compensation reference values not employed in the present invention. Only a predetermined number (e.g. 512) of the 540 pixels provide intelligible data; the first 18 pixels and last 10 pixels of the line scan do not generate valid data in the context of the present system.

ADC 320 is clocked by the 20 MHz signal from frequency doubler 322, and provides 6-bit digital signals indicative of the brightness level of each pixel. The 6-bit digital pixel brightness signals are communicated, preferably by a standard RS-422 communications link (not shown), to processor 120.

In accordance with one aspect of the present invention, the registration marks are symmetical in shape and preferably in the shape of a right angle diamond (i.e. a square rotated by 45 degrees). Symmetrically shaped register marks facilitate accurate determination of a predetermined point associated with the mark, e.g., the center points of the mark. The resolution of line scanner units 122 and 122A in the Y direction is limited to the height of the scan line, typically on the order of 0.01 inch, which is less than the desired accuracy of the system. The resolution of the scanner in the X direction is the pixel width (extent), e.g., 0.001 inch. Accordingly, the mark shape should be chosen so that any relevant edge is of a known geometry, disposed to be perceived in successive scans so that the Y position can be extrapolated. For example, the length of a straight line in the X direction from a point on the edge of a right angle diamond to the Y center line is equal to the distance from the intersection of the line and Y center to the nearest Y tip of the diamond. Consequently, the coordinates of the Y tips of a right angle diamond (and thus the Y coordinate of the center of the diamond) can be calculated from successive observations of the side edges (light-to-dark or dark-to-light transitions in a scan) between corresponding edge transitions in successive scans indicating the diamond tip. The X coordinate of the center is readily calculated as the midpoint between the light-to-dark and dark-to-light transitions in a scan (suitably averaged over the course of a plurality of scans).

Use of a symmetrical mark also tends to make the system less susceptible to error due to colorimetry changes. For example, when the center of a diamond-shaped mark is determined from the center of the scan (X value) and centerpoint of the diamond tips (Y value), variations due to colorimetry changes tend to cancel out. If the mark fades, the entire mark is perceived as shrinking. However, the respective sides and tips would move toward the centerpoint by equal amounts, so that the position of the perceived centerpoint would remain unchanged.

Processor 120 selectively collects and processes the pixel data from scanners 122 and 122A and generates control signals indicative of deviations in the relative positions of the registration marks from a predetermined relative disposition for application to a suitable motor controller 126 which, in turn, effects control of the motors associated with printing units 102–105. Processor 120 preferably comprises a conventional multiplexer 130 such as a 74A5857 hex 2 to 1 multiplexer, a conventional comparator 132 such as a 74A5885 8-bit comparator, a suitable dark level reference generator 134; respective conventional 8-bit counters 136, 140, and 148; a conventional microprocessor 144, such as an Intel iAPX 188 high-integration 8-bit microprocessor; a conventional 8-bit by 8K read-only memory (ROM) 150; an 8-bit by 16K RAM 152; a suitable direct-memory access (DMA) controller 138; and a 16-bit by 32-K dual port random access memory (RAM) 142.

DMA controller 138 may comprise a conventional Intel-8237 DMA controller chip. However, a preferred form of DMA controller utilizing a programmable logic chip will be described in conjunction with FIG. 4. Dual port RAM 142 suitably comprises two conventional 8-bit RAMs, such as Toshiba 2063P RAM chips, buffered and interconnected as known in the art to provide an effective 16-bit RAM. In practice, one or both of counters 136 and 140 may be integral timer/counters of CPU 144.

Dark level generator 134 provides a dark level reference signal indicative of ambient light level, applied to comparator 132 for use in characterizing a particular pixel as light or dark. If it is desirable to provide the same constant reference voltage for all pixels of the scan, dark level generator 134 may comprise a potentiometer and analog-to-digital converter or a conventional voltage divider network to establish a digital constant for application to comparator 132. If it is desired to provide separate dark level references for the individual pixels or groups of pixels of the scan corresponding to variations in ambient light at the location of the particular pixels, dark level generator 134 desirably comprises a RAM having a location corresponding to each pixel, in which the dark level reference for the particular pixel would be stored, for example, at start up of the system by CPU 144. The contents of the dark level reference RAM corresponding to the pixel being operated upon would be applied to comparator 132 by addressing the reference RAM with the same counter 422 (see FIG. 4) used to address RAM 142.

Processor 120 alternately operates in a data collection (acquisition) mode and a data processing mode. DMA controller 138, in cooperation with counters 136 and 140 and comparator 132, generates indicia of, e.g., a data word for transitions in brightness level of the nominal pixels along the successive line scans in a printing unit cycle (in effect, determining and generating indicia of the pixels (cells) which the marks darken in the successive scans) and selectively enters such data into dual port RAM 142. In the data processing mode, CPU, responsive to the indicia of transitions in RAM 142, determines and generates indicia of the relative position coordinates of the registration marks; CPU 144 accesses the data in RAM 142 and determines, from the symmetrical sides of the marks (as reflected in the transition data), a respective point associated with each mark, e.g., the centers of the observed marks. CPU 144 compares the position coordinates to expected values and generates registration control signals in accordance with deviations of the position coordinates from the expected values. In the data acquisition mode, the digital data from scanner units 122 and 122A are applied to the respective sets of input ports of multiplexer (MUX) 130. The pixel brightness data from scanner unit 122 or scanner 122A is thus selectively processed, chosen in accordance with control signals from CPU 144.

The pixel brightness data from the selected line scanner unit is compared to a dark level reference value corresponding to the pixel to determine whether the pixel is "black" (dark) or "white" (light). In this context, "black" signifies a pixel or element having lower reflectance than the unprinted web, which is adopted as the background region for establishing the "white" level. This "black" is utilized to describe, e.g., any of the printed colors, since they will be processed as black or dark pixels. The output of multiplexer 130 is applied to one input port of a comparator 132 (only 6 bits of comparator 132 used) for comparison against digital signals indicative of a nominal darkness level reference provided by dark level reference generator 134. Comparator 132 compares the digital brightness level of each pixel with the corresponding reference dark level from generator 134 and creates a light/dark signal (L/D) wherein one and zero values indicative light and dark pixels, respectively.

Counters 136 and 140 provide synchronization between processor 120, scanners 122 and 122A and print units 102–105; counter 136 provides indicia of the particular pixel in a line scan being processed and counter 140 provides indicia of the operational cycle of printer units 102–105. Counter 136 (enabled by a signal from DMA controller 138 signifying the start of valid data) maintains a count characteristic of the "pixel number" (i.e., the relative position of the pixel in the line scan) of the particular line scan pixel being processed. The terminal count, i.e., carry bit, (EOS) of counter 136 is representative of the completion of a scan. The pixel count from counter 136 is applied to DMA controller 138 together with the light/dark signal from comparator 132 corresponding to that pixel. Counter 140 cooperates with shaft encoder 124 to provide indicia of the end of each revolution (operational cycle) of the printing cylinders of printing units 102–105. Shaft encoder 124 is mechanically coupled to one of the plate cylinders of printing units 102–105, and generates a predetermined number of counts (suitably 32) for each revolution of the print unit cylinders. Counter 140, responsive to the encoder output signal, generates a carry bit (EORev signal) upon the completion of the rotational cycle. The end-of-revolution (EORev) signal is applied to DMA controller 138 and to CPU 144 as an interrupt signal.

Counter 148 maintains a count of the number of scans made in a given printing cycle. Specifically, counter 148 is initially set to zero by the end of revolution signal (EORev) from counter 140. Thereafter, counter 148 is incremented once per scan by the carry bit signal from counter 136. As will hereinafter be explained, the scans-per-revolution count is utilized to determine the Y extent of each scan.

At the end of a printing cylinder revolution, the end-of-revolution (EORev) signal from counter 140 is applied as an interrupt to CPU 144. Assuming that unprocessed data is not already resident in RAM 142 (as reflected in a status flag in RAM 152), the positive going transition in the end-of-revolution signal (EORev) causes CPU 144 to generate a control signal (AEN) to DMA controller 138, enabling the data collection process. Data entries corresponding to each light-to-dark and dark-to-light transition in the brightness level of respective successive line scans, together with indicia of the end of each line scan and indicia of the end of the print unit operational cycle, are then made by DMA controller 138 into successive locations of dual port RAM 142.

Figure 6A:
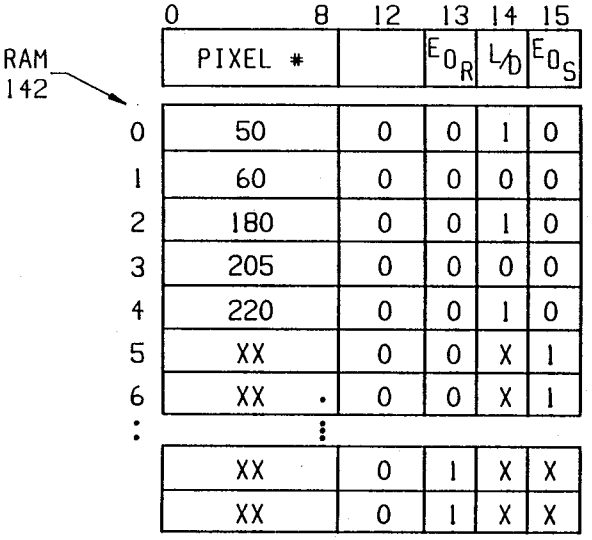
FIG. 6A is a schematic representation of transition data in ram 142.

DMA controller 138 detects transitions from light-to-dark and dark-to-light between successive pixels of a line scan, determining the relative positions of the transitions along the line, and, for each such transition (and for each end of scan), enters a 16-bit data word into dual port RAM 142, including indicia of the relative position of the transition within the scan, e.g., the pixel number at which the transition occurs, whether the transition is from light-to-dark or dark-to-light, and whether the entry corresponds to an end-of-scan or end-of-revolution. At the end of the printing unit cycle, RAM 142 will contain, for successive scans, sequential words corresponding to each brightness transition in each line scan, delimited by an end-of-scan marker word. The words associated with successive line scans are stored sequentially in RAM 142 until the end-of-revolution is sensed. The format of the respective data entries in RAM 142 is illustrated in FIG. 6A (in which data entries are depicted in decimal form for ease of illustration).

Figure 4:
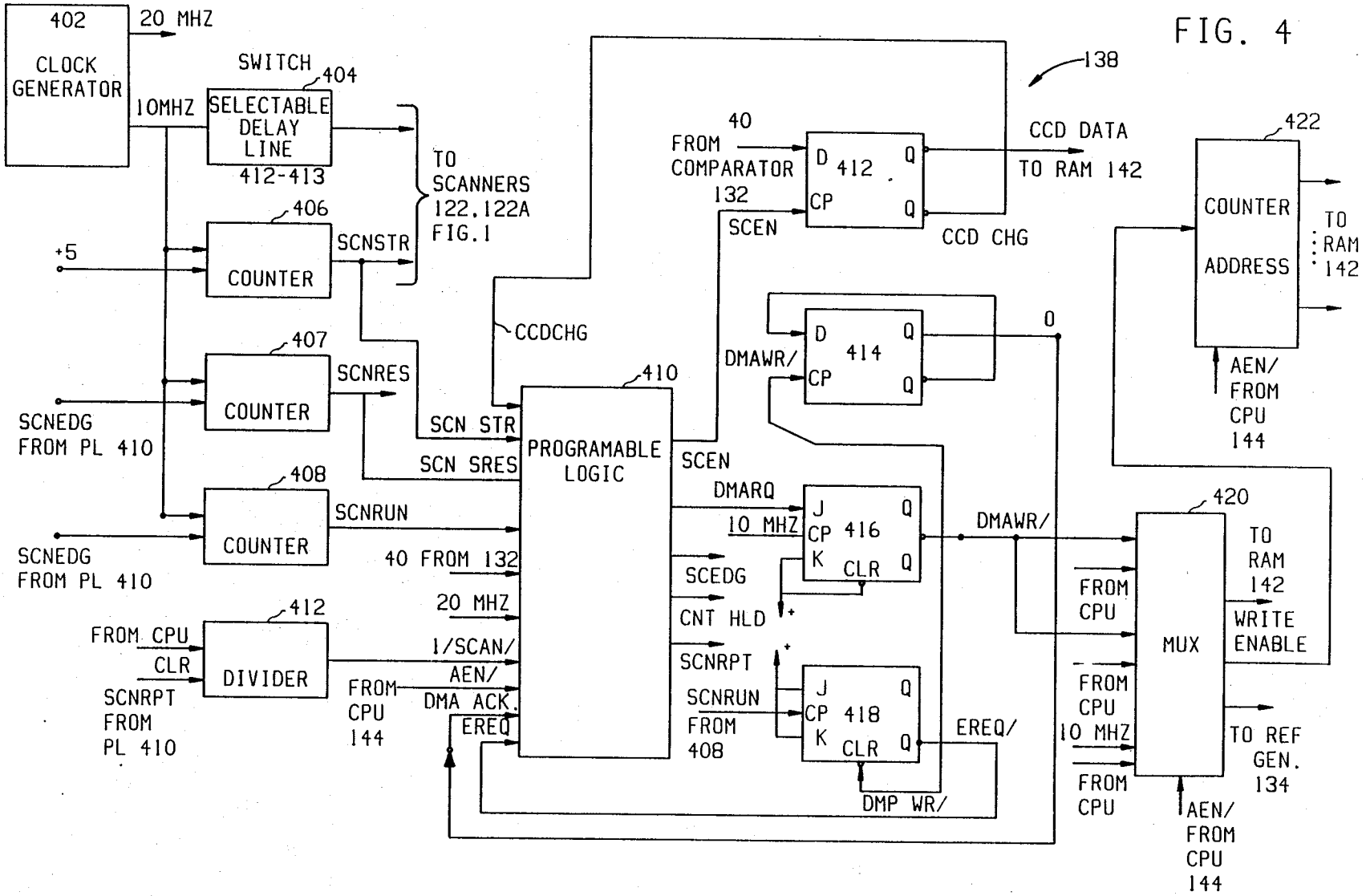
FIG. 4 is a schematic block diagram of a preferred DMA controller 138 of FIG. 1.

More specifically, with reference to FIGS. 1 and 4, the preferred embodiment of DMA controller 138 comprises a suitable clock generator 402; conventional 8-bit programmable counter/dividers 406, 407, 408 and 412; suitable portions of 8254 programmable counter/divider chips; a conventional programmable logic chip 410, such as a Signetics 82S153A programmable logic chip; a latch 412; respective flip-flops 414, 416 and 418; a conventional multiplexer 420, such as a 74F157 quad 2-to-1 multiplexer; and an 8-bit counter 422.

Clock generator 402 provides both 10 MHz and 20 MHz signals. The 10 MHz signal is derived from the 20 MHz clock through a 74F74 flip-flop in a divide-by-two mode. The 10 MHz clock is applied through a conventional switch-selectable delay line 404 to scanner units 122 and 122A (typically through an RS422 datalink, not shown). Delay line 404 is utilized to compensate for delays inherent in transmissions between the remote scanner unit and processor 120.

Counters 406, 407, and 408, driven by the 10 MHz clock, are utilized to generate respective timing control signals: SCNSTR, SCNRUN and SCNRES. The SCNSTR signal from counter 406 indicates the beginning of a scan cycle; one pulse is generated at the beginning of each predetermined scan cycle period, suitably 26 microseconds. The SCNRES signal is high during the period in which intelligible data is generated by scanner unit 122, and the SCNRUN signal goes high at the end of the period during which the scanner 122 generates intelligible data. More specifically, scanner 122 effects line scans of 540 pixels in length. However, only 512 of such pixels provide intelligible data; the first 18 pixels and last 10 pixels of the line scan do not generate valid data. Accordingly, control signals SCNSTR, SCNRES and SCNRUN are generated to initiate the scan, and provide indicia of the beginning and end of useful data generation.

Counter/divider 412 is utilized to provide a signal indicative of line scans of interest. In low press speed applications, it is not necessary to analyze the data from each successive scan taken by scanner unit 122; rather, only scans at predetermined intervals, e.g., every other scan or every fourth scan, are of interest. Accordingly, divider 412, appropriately preset by CPU 144, generates an output signal (1/SCAN) which assumes a low value only at predetermined intervals, corresponding to a predetermined number of clock pulses. Where all scans are of interest, divider 412 is preset with the value one.

The timing control signals SCNSTR, SCNRES and SCNRUN, and 1/SCAN control signal are applied to programmable logic chip 410, together with the light-/dark signal (L/D) from comparator 132, the 20 MHz clock, the control signal (AEN) from CPU 144, and respective signals generated by latch 412 and counters 414, 416 and 418, CCDCHG, DMAACK, and EREQ.

Programmable logic 410 generates respective output signals in accordance with preprogrammed boolean algebra functions of the input signals:

SCaN EDGe=1/SCAN AND SCNSTR (used to count scans actually put into memory);

SCan ENable=SCNRUN AND SCNRES/ AND CLK20M AND (DMAACK EXclusive OR CCDCHG) (clocks CCD change latch 412 during valid part of scan if no DMARQ is pending, stops clocking when DMARQ is asserted so a stable state is put into RAM 142);

DMA ReQuest=SCNRUN AND SCNRES/ AND (DMAACK EXclusive NOR CCDCHG) OR EREQ (requests a DMA cycle during valid part of scan if CCD change latch 412 has just changed and CCD write latch 414 has yet to change, indicating [(new light-to-dark) or (dark-to-light transition)] or [EREQ indicates that a scan has completed, so a marker must be placed into RAM 142;]

CouNT HoLD=SCNRUN AND SCNRES/ AND (DMAACK Exclusive NOR CCDCHG) (freezes the pixel count, light-dark status, end-of-scan, and end-of-revolution status present for input to RAM 142);

SCaN RePeat/=SCNSTR inverted.

As previously noted, DMA controller 138 detects brightness transitions in the pixel data. In this regard, programmable logic 410 cooperates with a latch 412 and flip-flops 414, 416, and 418 to generate a stable signal (LCCD DATA) indicative of light-to-dark and dark-to-light transitions in the brightness level of the pixel data. The light/dark signal from comparator 132 is applied to the D input of latch 412. Programmable logic 410 generates the scan enable (SCEN) signal to continually clock latch 412 during the valid part of the scan so long as no DMA request (DMARQ) is pending, but ceases to clock when a DMA request is asserted, causing latch 412 to capture the instantaneous value of the light/dark signal from comparator 132 and stable input to RAM 142.

DMA request is asserted whenever there is a transition from light-to-dark or dark-to-light in the light/dark (L/D) signal. In essence, the contents of latch 412 reflects the instantaneous value of the light/dark signal from comparator 132. The contents of flip-flop 414 reflects the value (light or dark) of the pixel just previously written into memory. When the respective contents of latch 412 and flip-flop 414 differ, as reflected in the polarities of signals CCDCHG and DMAACK, generated by latch 412 and flip-flop 414, respectively, a light-to-dark or dark-to-light transition has occurred. When divergent states in the CCDCHG and DMA acknowledge (DMAACK) signals are sensed in programmable logic 410, (during the valid portion of the scan) a DMA request (DMARQ) signal is generated. Upon generation of the DMARQ signal, programmable logic 410 ceases to apply clock signals (SCEN) to latch 412, causing latch 412 to retain the value of the light-/dark signal at the point of transition. The DMARQ signal is also applied to flip-flop 416. Upon application of the DMARQ signal to flip-flop 416, a negative-going 5 MHz (10 MHz divided by 2) square wave signal is generated as DMA write (DMAWR/) at the Q/ of flip-flop output of 416. The DMAWR/ signal is applied to the clock input of flip-flop 414. Flip-flop 414 is connected in a toggle mode, and when clocked by the positive-going edge of the first cycle of DMAWR/ causes DMAACK signal to change state, i.e., assume the same state as the present content of latch 412. When the DMAACK signal assumes the same state as the CCDCHG signal from latch 412, programmable logic 410 causes the DMARQ signal to go inactive.

As previously noted, data entries to RAM 142 are made in connection with each transition in the brightness level of the line scan pixel data. In this regard, the DMAWR/ signal generated by flip-flop 416, while enabled by the DMARQ signal, is applied to the clock input of flip-flop 414, the clear input of flip-flop 418, and two input ports of multiplexer 420. Multiplexer 420 is utilized to facilitate switching between the DMA data collection mode operation and the data processing mode in which CPU 144 accesses the contents of dual port RAM 142. During the DMA data collection mode operation, the DMAWR/ signal is applied to RAM 142 as a write enable signal, and to address counter 422 as clock. Specifically, the leading edge of the DMAWR/ pulse effects a write operation into RAM 142 at the location indicated by the content of address counter 422. The trailing edge of the DMA write pulse then increments counter 422 to facilitate the next data entry.

A data entry to RAM 142 is also made in connection with the end of each scan, as noted above. Flip-flop 418, in cooperation with programmable logic 410 forces the generation of a DMARQ at the end of each scan, causing entry of a data word. Specifically, flip-flop 418 is connected in a one-shot configuration, and is clocked by the negative-going edge of the SCNRES signal from counter 408 (the SCNRES signal goes low upon the initiation of the scan and goes high at a point corresponding to the first pixel of intelligent data). Upon application of SCNRES, the Q/ output (EREQ) of flip-flop 418, applied to programmable logic 410, goes low, causing programmable logic 410 to generate a DMA request (DMARQ). The DMARQ signal causes the DMA write (DMAWR/) signal to be generated, causing (during the data collection mode) entry of a data word into RAM 142 and the incrementing of address counter 422. The DMA write signal (DMAWR/) also clears flip-flop 418, causing the EREQ/ signal to go high, whereupon programmable logic 410 renders the DMA request (DMARQ) signal inactive.

Figure 5:
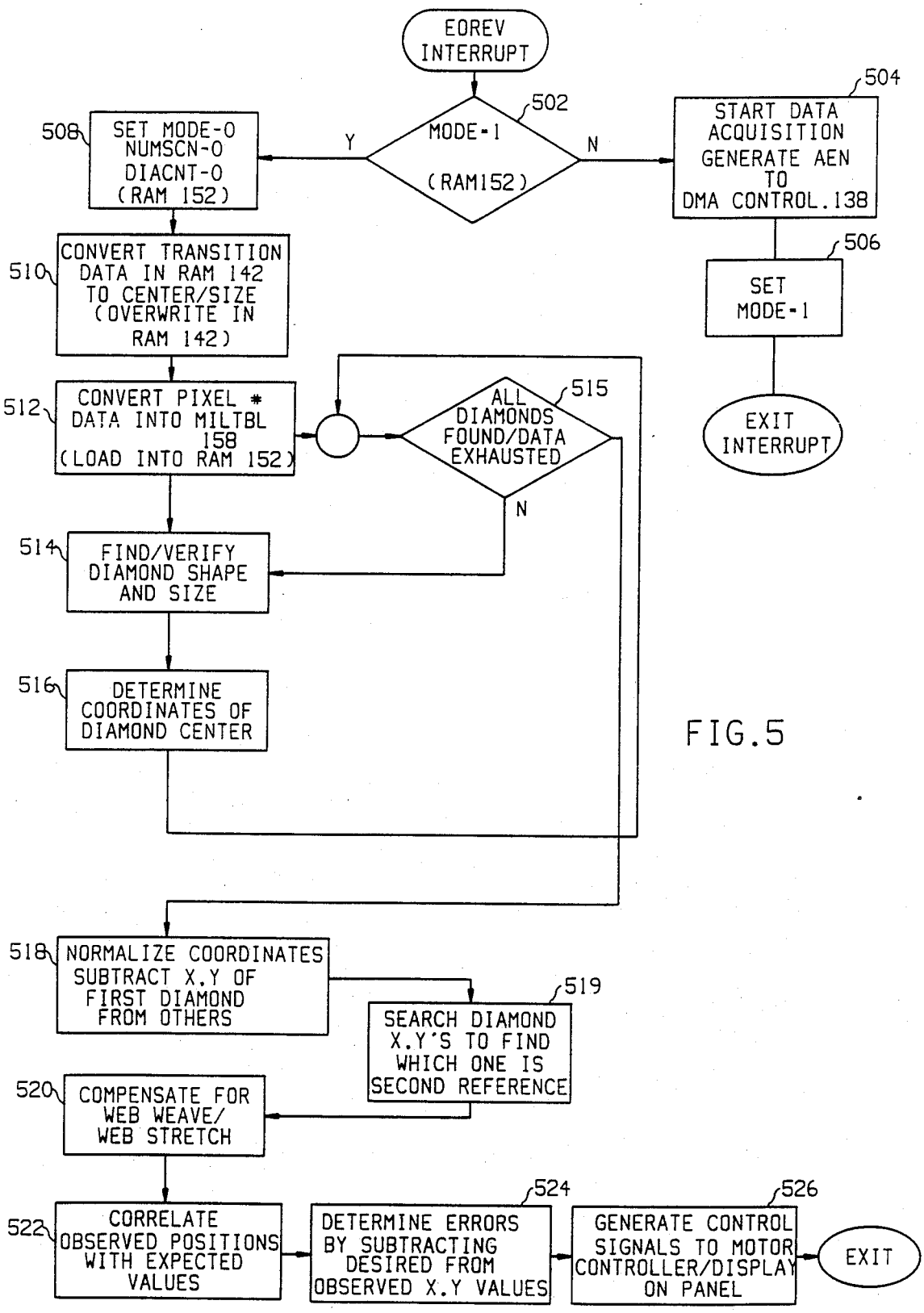
FIG. 5 is a general flow chart of the processing mode operation of the system of FIG. 1.

Referring now to FIGS. 1,1A and 5, the data processing mode operation of processor 120 will be described. During the data processing mode, CPU 144 effects sequential operations in accordance with a program prestored in ROM 150. In connection with the data processing, CPU 144 directly accesses and operates upon the transition data in dual port RAM 142, and the scans-per-revolution count in counter 148, as well as prestored parameter values in RAM 150 and RAM 152.

In addition to a plurality of internal registers (ACC1, ACC2 . . . P1, P2, . . . ), CPU 144 defines a plurality of effective registers, and fixed-length arrays (tables) in RAM 152 as detailed in FIG. 1A;

STATUS 153—register containing respective status flags, including the mode flag;

NUMDIA 156—the number of diamonds employed in the register mark, keyed in by the operator through panel 146;

MILTBL 158—fixed-size array of 1200 locations utilized to store three-word data sets (Y coordinate, X center coordinate and size) for each data transition pair within predetermined size limits);

ENDMLM 160—the address of the last entry in the mil table;

SCANCOUNT 162—the number of scans processed;

TIPSTBL 164—a fixed-size array of 200 locations used to store four-word data sets (X center, low Y tip, high Y tip, pointer to corresponding data in MILTBL), for each transition pair relating to an individual mark;

DIACOUNT 166—an ongoing count of diamonds located during the data processing;

DIAPLC 168—number of diamonds placed, i.e., correlated (matched), with a particular set of expected coordinates;

AVGLOT 170—average low tip value of diamond being processed;

AVGHIT 172—average high tip of diamond being processed;

SCNUM 174—count of scans used;

DIAXYS 178—a fixed-length array of 18 locations for storing two-word data sets (X coordinate of center, Y coordinate of center) for each diamond located;

DIADSP 180—a fixed-length array, having a particular two-word sets of locations (X error, Y error) corresponding to each printing unit 102–105;

TIPTOP 184—a pointer to the last entry in TIPSTBL (i.e., tips table) for a given mark;

MILSCAN 186—indicia of the Y extent of a scan, i.e., mils per scan.

ROM 150 includes indicia of various system parameters register and arrays including:

MILCEL—the number of mils per pixel. i.e., the X extent of each pixel, fixed for particular optics of scanner;

DIALLM—lower limit of diamond size (92 mils);

DIAULM—upper limit of diamond size (156 mils);

TPYTOL—the maximum amount of Y deviation for a tip, e.g., 3 mils;

TPXTOL—the maximum amount of X deviation for a tip, e.g., 9 mils;

RF2XMN—the minimum relative displacement limits for the second reference diamond location in relation to the first reference diamond in the X direction;

RF2XMX—the maximum relative displacement limits for the second reference diamond location in relation to the first reference diamond in the X direction;

RF2YMN—the minimum relative displacement limits for the second reference diamond location in relation to the first reference diamond in the Y direction;

RF2YMX—the maximum relative displacement limits for the second reference diamond location in relation to the first reference diamond in the Y direction;

REF2XY—a two-word array containing expected XY coordinate of second reference diamond;

CLXMN—an array containing a four-word entry for each diamond expected (Xmin, Xmax, Ymin, Ymax);

COLXY—an array containing a two-word entry for each expected diamond (X,Y);

TIPNUM—minimum number of correlating tips, e.g., 3.

After the data corresponding to a printing unit cycle is collected in dual port RAM 142, the EORev interrupt to CPU 144 causes CPU 144 to effect a data processing mode operation and the DMA controller 138 is temporarily disabled. Specifically, and with particular reference to FIG. 5, upon the EORev interrupt, CPU 144 effects a status check of a mode flag, advantageously disposed in a status register in RAM 152 (Step 502). If the flag is active, indicative of unprocessed data in RAM 142, the data processing mode is started, as noted above. If the mode flag is inactive, the data acquisition mode is initiated by generating the AEN signal to DMA controller 138 (Step 504), and the mode flag is set to zero (Step 506). Where a timer integral to CPU 144 is utilized for counter 140, the status bit of such counter can typically be used as the mode flag.

Upon entry into the data processing operation, the mode flag is reset to inactive, and respective counts reset to zero (Step 508). The data in RAM 142 (in terms of pixel number and transitions) is then converted into terms of center and size of (distance between) successive transitions (transition pairs) in the respective scan lines, and overwritten into the same locations in RAM 142 (Step 510). This conversion process will be more fully described in conjunction with FIG. 6. The center/size data in RAM 142, still in terms of pixel numbers, is then converted into terms of inches (mils) and a mil table (MILTBL) is developed in RAM 152 (Step 512). The generation of MILTBL in RAM 152 will be more fully described in conjunction with FIG. 7.

The data is then analyzed to identify the transition pairs associated with the first sequential mark which meets predetermined criteria as to size and shape (Step 514), e.g., those which correlate with criteria for a right angle diamond of predetermined size. Step 514 will hereafter be described in conjunction with FIG. 8.

The center of the area defined by the transitions associated with the mark is then determined and indicia of the nominal center coordinates of the mark is generated. Assuming a nominal X, Y coordinate system with the Y axis parallel to the direction of paper movement and the X axis parallel to the scan lines, the X and Y coordinates of the center of the mark are determined from the transition pair data identified as associated with the mark (Step 516).

Each diamond-shaped mark is located, in sequence, and the center coordinates determined. The process is continued until the expected number of diamonds are located or the mil table (i.e., MILTBL) data is exhausted (Step 515).

The center coordinates are then normalized by subtracting the center coordinate of a designated reference mark (typically the first occurring mark) from the coordinate of the other marks (Step 518). Step 518 will be described in conjunction with FIG. 10.

In some instances, the direction of web movement deviates from perpendicular to the scan line, e.g., due to web weave. Changes in the direction of web movement are erroneously perceived by the scanner as X-registry deviations. Similarily, stretching or shrinking of web 110 causes the scanner to erroneously perceive Y-registry deviations. It is desirable to discriminate against and compensate for X and Y deviations not caused by misregistration.

The nominal center coordinates of the marks are adjusted for such non-registry related deviation. Perceived X and Y deviations not due to misregistry are compensated for using factors determined by analysis of the perceived relative disposition of the two reference diamonds (diamonds 202 and 203 in FIG. 2). Since both reference diamonds are printed by the same cylinder, any deviation in the normalized position of the second reference diamond must be due to an instrinsic factor other than registry. The first diamond observed is deemed to be the first reference diamond (e.g., 202). However, the observed diamond corresponding to the second reference diamond must be identified (Step 519). A compensation factor is then determined and the normalized X, Y center coordinates varied accordingly (Step 520). Steps 519 and 520 will be more fully described in conjunction with FIGS. 11 and 12, respectively.

The normalized, compensated center coordinates are then compared to predetermined expected values to determine whether the observed marks generally correspond to the marks printed by the individual printing units 102—105, i.e., are within registration tolerance (Step 522). Step 522 will be more fully described in conjunction with FIG. 13.

The deviation of the relative position of each mark from a respective predetermined expected position is then determined; the normalized, observed values are subtracted from the compensated, expected values to determine the raw registration error (step 524). Control signals are then generated in accordance with the deviations; indicia of the registration error is then displayed on control panel 146, and registration error signals generated to motor controller 126 (Step 526).

Figure 2A:
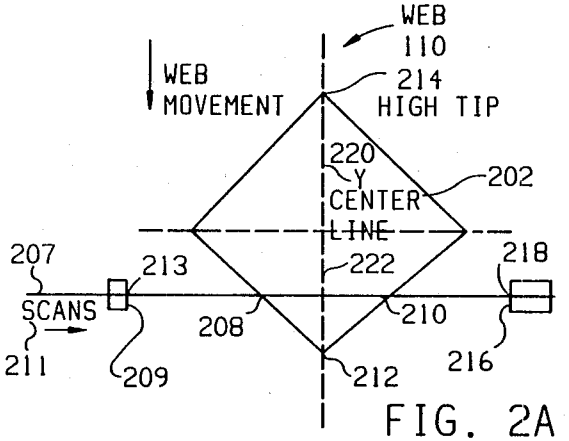
FIG. 2A illustrates light-to-dark transitions during the scan of a registration mark.

Turning to FIG. 6A, it should be recalled that RAM 142 contains, in successive locations, 16-bit words corresponding to successive transitions, each word containing the following data: a 9-bit pixel number field (bits 0–8); a field of four unused bits (9–12); an end-of-revolution flag (bit 13, active indicates the end of revolution); a light/dark bit 14 (0 indicating a dark-to-light transition, 1 indicating a light-to-dark transition); and an end-of-scan flag, bit 15 (active indicating the end of a line scan). For example, in the illustration of FIG. 6A, location 0 of RAM 142 reflects a light-to-dark transition (bit 14=1) at pixel 50 (decimal notation is used in FIG. 6A for convenience). The contents of RAM 142 location 1 indicates that the next successive brightness transition from dark-to-light (bit 14=0) occurs at pixel 60. Referring briefly to FIG. 2A, such transitions could relate to light-to-dark and dark-to-light transitions sensed during a scan 207 at points 211 and 213 at the edges of a wood chip 209 in web 110. Returning again to FIG. 6A, from the contents of locations 2 and 3 of RAM 142, it appears that a further transition from light-to-dark occurs at pixel 180 followed by a transition from dark-to-light at pixel 205 (RAM location 3) occurring in the same scan (EOS bit 15=0). Looking back to FIG. 2A, the light-to-dark transition at point 208 and dark-to-light transition at point 210, would comprise such a transition pair. Thus, two transition pairs are associated with the scan.

Again, with reference to FIG. 6A, location 4 of RAM 142 reflects a transition from light-to-dark (bit 14=1) at pixel 220. However, an end-of-scan delimiter (marker) (bit 15=1) occurs at location 5, prior to any corresponding dark-to-light transition. Such a circumstance can arise from a spurious mark 216 on web 110 (FIG. 2A) extending to the edge of the web. A light-to-dark transition is sensed at point 218, but the scan is completed without sensing a corresponding dark-to-light transition. The pixel number and light-to-dark transition fields of the end-of-scan marker such as in location 5 are not utilized by the system. Even where no transitions are detected in a given scan, an end-of-scan delimiter is included in RAM 142, as reflected in location 6. RAM 142 contains similar data for each light-to-dark and dark-to-light transition sensed, delimited by end-of-scan markers until an end of revolution (reflected by 1 in bit 13) is detected by the system.

As previously noted, to facilitate processing, the transition data in RAM 142, originally in terms of pixel numbers, is converted into terms of the center and size of pairs of sequential transitions (Step 510). Referring now to FIG. 6, the conversion step will be more fully described.

An address pointer P1 in CPU 144 is used to designate the location in RAM 142 to be operated upon. Pointer P1 is initially set to the first location in RAM 142 (e.g., location 0) containing transition data (Step 602). The transition data corresponding to a transition pair (successive transitions in a given line scan) are loaded into accumulator ACC 1 and accumulator ACC 2 of CPU 144, respectively. More specifically, the contents of the location of RAM 142 designated by pointer P1 (initially location 0) is first loaded into accumulator ACC 1 in CPU 144 (Step 604).

Tests are then made to ensure that the data represent a transition, as opposed to an end of scan-of-end of revolution marker. Bit 15 of the first transition data entry in accumulator ACC1 is tested to make sure that the word does not represent an end-of-scan marker (Step 606). If bit 15 is active, indicating the end of a scan (Step 606), bit 13 of the word is then tested to determine if the word also represents the end of a print cylinder revolution (Step 608). If not, pointer 1 is incremented by 1 (Step 610) and the contents of the next successive location of RAM 142 loaded into accumulator ACC1 (Step 604) for processing. If the word initially loaded into accumulator ACC1 (604) is not a end-of-scan delimiter (i.e., bit 15 is inactive), bit 13 of the word is likewise tested to determine if the end of a revolution has occurred (Step 612). If the word reflects an end-of-revolution (Step 608, 612), the conversion is complete and the program proceeds to execute Step 512 (see FIG. 5).

Assuming that neither the EOR flag (bit 13) nor EOS flag (bit 15) of the word currently in ACC1 is inactive, pointer 1 is incremented to designate the next successive location in RAM 142 (Step 614), and the contents of that location loaded into accumulator ACC2 in CPU 144 (Step 616).

The end-of-scan flag in bit 15 of the second transition data word (accumulator ACC2) is tested to determine whether the word represents a valid transition or an end-of-scan delimiter (Step 618). If the second transition word represents an end-of-scan delimiter, a premature end-of-scan has occurred (i.e., a light-to-dark transition occurs without a corresponding dark-to-light transition). Such a premature end-of-scan is illustrated by the contents of locations 4 and 5 of RAM 142 (See FIG. 6A). Where a transition has no corresponding opposite transition, the initial transition is not usable. Accordingly, in that case an "unusable" flag (bit 12) in accumulator ACC1 (the first transition) is rendered active, and the contents of accumulator ACC1 loaded back into the original location (identified by the present contents of pointer P1 minus 1) in RAM 142.

Assuming, however, that the end-of-scan test (Step 618) indicates that the second data word (in accumulator ACC2) represents a brightness transition, the distance between transitions (in terms of number of pixels) is calculated and compared to a minimum value (Step 620). The minimum value (e.g., 8 pixels) is suitably stored in ROM 150. Assuming that the distance between transitions is sufficiently large, the center and size of the transition pair are calculated and loaded into accumulators ACC1 and ACC2, respectively (Step 622). More specifically, the pixel numbers of the first and second transitions are added, and the sum divided by two to determine the center. The size (the number of pixels along the scan line into which the registration mark extends) is determined by subtracting the pixel number of the first transition from the second.

If, however, it is determined that the size of the transition pair is less than 8 pixels (Step 620), the transitions are deemed spurious, and the "unusable" flag bits 12 in both accumulator ACC1 and accumulator ACC2 are rendered active.

In either event, the contents of accumulator ACC1 and accumulator ACC2 are then loaded into the original corresponding locations in RAM 142 (Step 626). Pointer 1 is then incremented to designate the next successive location in RAM 142 (Step 628), and the foregoing sequence of steps (604–628) repeated.

The sequence is repeated until an active end-of-revolution flag is detected during either Step 608 or 612, whereupon the program proceeds to convert the data from terms of pixel numbers into terms of inches, and generate the mil table (i.e., MILTBL) in RAM 152.

Figure 6B:
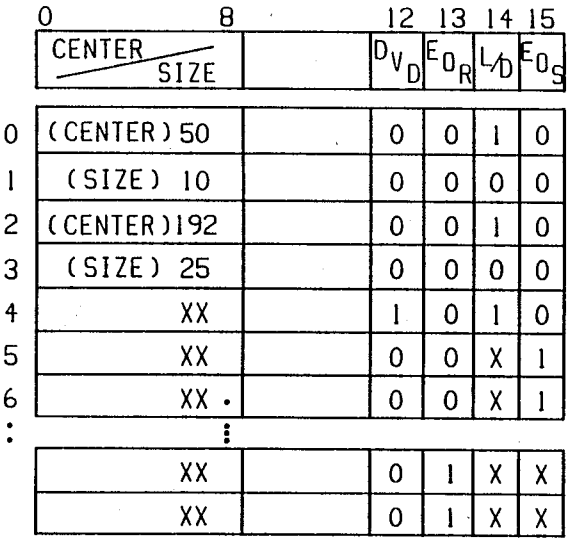
FIG. 6B is a schematic representation of the center/-size data in ram 142.
Figure 6:
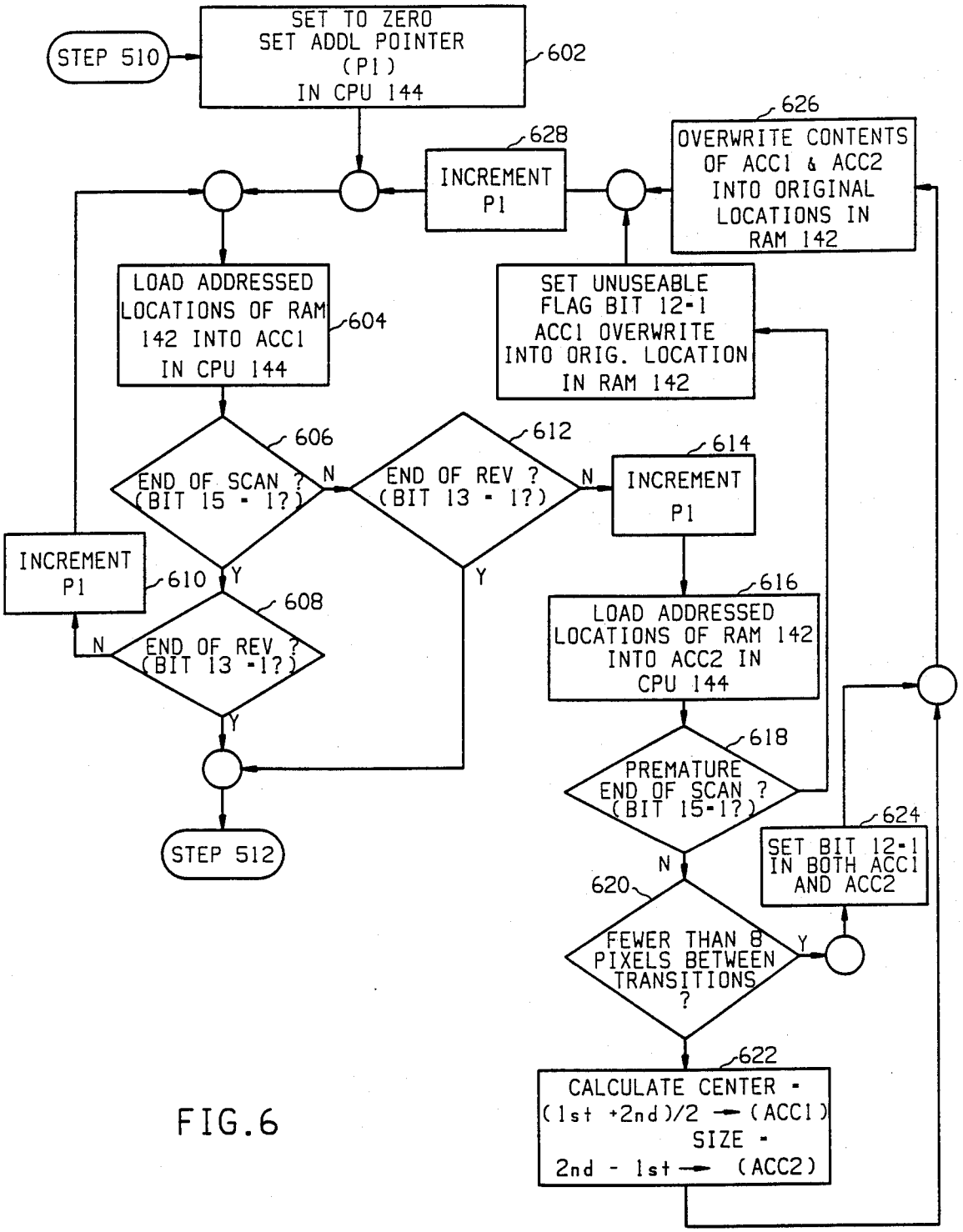
FIG. 6 is a flow chart of conversion of transition data to center/size data.

By way of illustration, FIG. 6B shows center/size converted data corresponding to the transition data illustrated in FIG. 6A. The initial transition pair reflected in locations 0 and 1 (light-to-dark transition at pixel 50, dark-to-light transition at pixel 60) are converted to a center value of 55, stored in the first nine bits of location 0 $(50+60)/2=55$) and a size value of 10 $(60-50=10)$ stored in the first nine bits of location 1.

At the end-of-conversion step 510, RAM 142 contains respective two-word data sets corresponding to each transition pair, together with flagged unusable data (bit 12 active), and end-of-scan marker corresponding to each scan, and one or more end-of-revolution markers.

As previously noted, once the data in RAM 142 have been converted to terms of center/size of pairs of successive transitions and are identified (Step 510), the data are then converted into terms of inches, and a mil table generated in RAM 152 (Step 512). As previously noted, the mil table is a fixed-length array (1200 locations) utilized to store three-word data sets (Y coordinate, X the center coordinate, and size) for each data transition pair meeting predetermined size requirements.

Figure 7A:
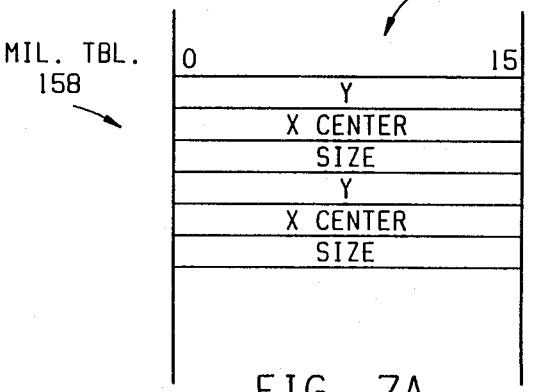
FIG. 7A is a schematic representation of the contents of mil table 158.
Figure 7B:
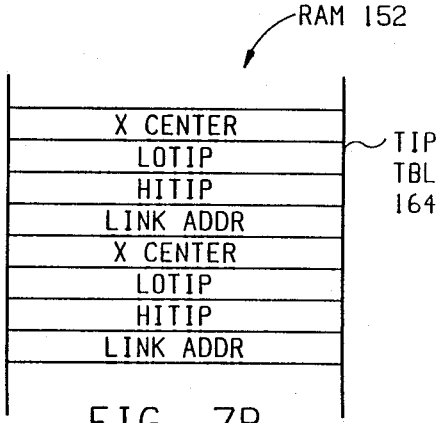
FIG. 7B illustrates the contents of tips table 164 in ram 152.
Figure 7:
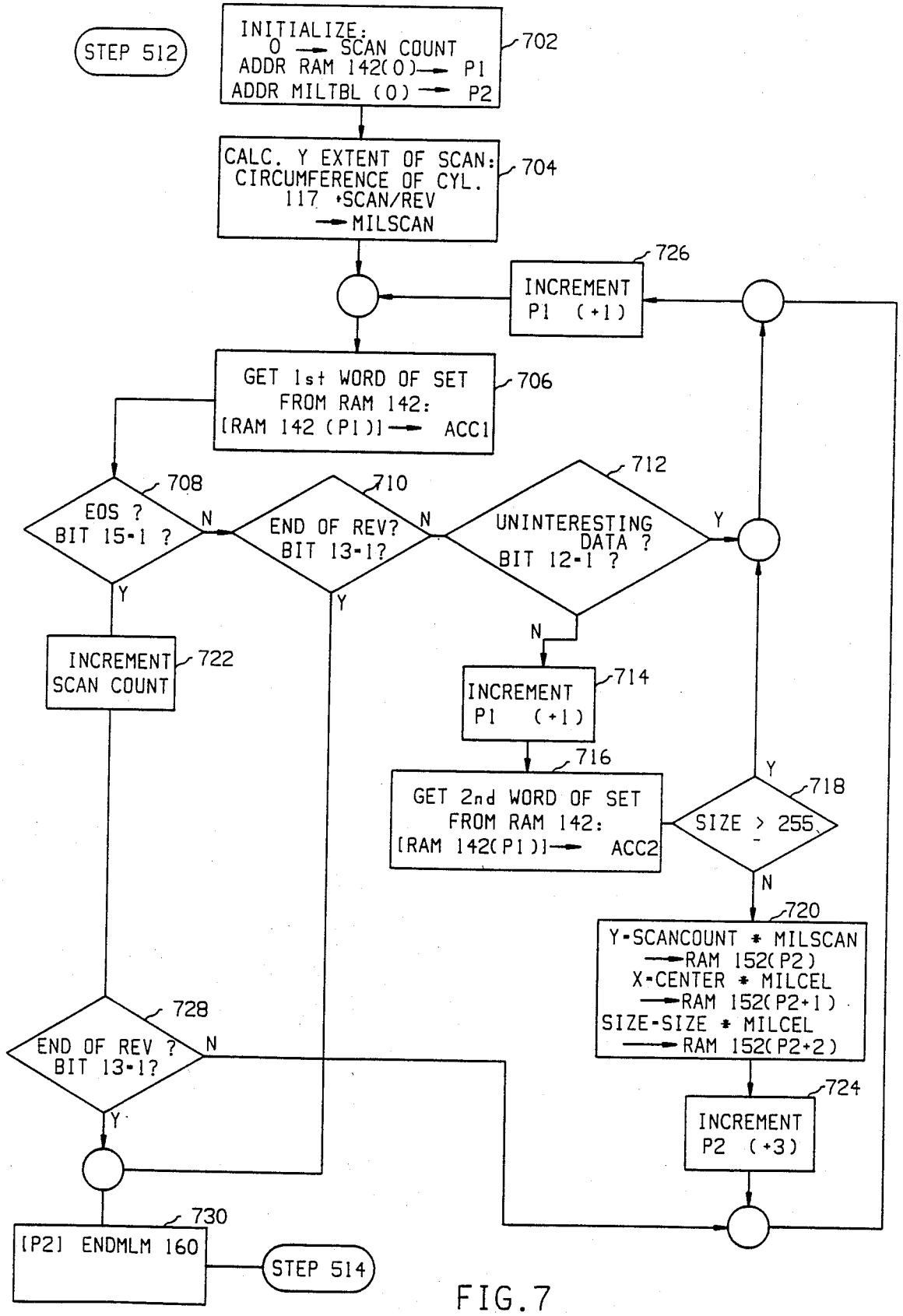
FIG. 7 is a flow chart of the generation of the mil table in ram 152.

Referring now to FIG. 7, the conversion to inches and generation of MILTBL (Step 512) will be more fully described. Upon initiation of the mil table generation step (Step 512), various counters and pointers are initialized. The scan count register in RAM 152 (maintaining a count of the number of scans processed) is initially set to zero. Address pointers, P1 and P2, internal to CPU 144, are initially loaded with the address of the transition data entry in RAM 142 (address RAM 142(0)) and the address of the beginning of the mil table in RAM 152 (address MILTBL (0)), respectively (Step 702).

The Y extent of a scan is then calculated and stored in the MILSCAN register 186 in RAM 152 (Step 704). More specifically, the circumference of printing cylinder 117 in mils (a known constant) is divided by the scans/rev count in counter 148, and the result loaded into MILSCAN register 186.

An entry into MILTBL in RAM 152 is then made for each set of data in RAM 142 corresponding to a valid transition pair. More specifically, a first word of RAM 142 (designated by pointer P1, initially location 0) is loaded into accumulator ACC1 in CPU 144 (Step 706). A sequence of checks is then performed to determine if the word is the first word of a valid transition pair data set, as opposed to, for example, an end-of-scan or end-of-revolution delimiter. Specifically, bit 15 of a word is tested to determine if the word is an end-of-scan delimiter (Step 708). Bit 13 of the word in accumulator ACC1 is tested to determine if the word represents an end-of-scan delimiter (Step 710). Likewise, bit 12 is tested to ensure that the word does not reflect unusable data (as determined by Step 618 or 620).

Assuming that the first word represents valid data as determined by Steps 708, 710 and 712, the next successive word in RAM 142 is loaded into a second accumulator (ACC2) in CPU 144. Specifically, pointer P1 is incremented by one and the location in RAM 142 indicated by the content of pointer P1 loaded into accumulator ACC2 (Step 716). Accumulator ACC1 thus contains the first word (center), e.g., location 0, of RAM 142 in FIG. 6B and accumulator ACC2 contains the second word (size), e.g., location 1, of RAM 142 of a center/size data set for a transition pair.

The size of the transition pair (accumulator ACC 2, bits 0–8) is then tested against a predetermined constant, e.g., 255, to ensure that an overflow condition will not occur (Step 718).

Assuming that the size of the data pair is within limits, a data entry corresponding to the transition pair is generated in MILTBL 158. More specifically, a Y value for the transition pair is calculated by multiplying the number of the scan in which the transition pair occurs (the contents of the scan count register 162 in RAM 152) times the Y extent of each scan, i.e., mils per scan (the contents of MILSCAN register 186) (Step 720). The scan count is calculated by incrementing the contents of SCANCNT register 162 each time an end-of-scan is sensed in Step 708 (Step 722). The calculated Y value is loaded into the location in RAM 152 designated by pointer P2.

The X center in terms of mils is then calculated by multiplying the center value in accumulator ACC1 by a constant MILCELL, indicative of the X extent of each individual pixel, determined by the particular optics of scanner 122, 122A. The MILCELL constant is maintained in RAM 150. The calculated X center value is then loaded into the next successive location in RAM 152.

Similarly, the size in terms of mils is calculated by multiplying the size, in number of pixels from accumulator ACC2, times the MILCELL constant from RAM 150. The calculated value is then loaded into the next successive location in RAM 152. Thus, for each data transition pair, a 3-word entry is made in MILTBL 158 comprising a Y value, a X center value, and a size value. MILTBL 158 is illustrated schematically in FIG. 7A.

After a data entry is made into MILTBL 158, the next successive transition pair entry addressed. More specifically, pointer P2 is incremented by 3 to point to the next open address in MILTBL 158 (Step 724), and pointer P1 is incremented to designate the next successive word in RAM 142 (Step 726), and the contents of the designated location loaded into accumulator ACC1 (Step 706) to repeat the foregoing sequence of steps.

When an end-of-scan (bit 15 equals 1) is detected in Step 708, the contents of SCNCOUNT register 162 is incremented (Step 722) as previously noted, and bit 13 is tested to determine whether an end-of-revolution has occurred (Step 728). If an end-of-scan is sensed (Step 708), but the word does not also reflect and end-of-revolution (Step 728), pointer P1 is incremented (Step 726), and the next successive word in RAM 142 loaded into accumulator ACC1 (Step 706) for processing.

Likewise, where the test of bit 12 of a word indicates that the word does not reflect valid data (Step 712) or where the size of the transition pair is in excess of that which can be accommodated by the system (Step 718), pointer P1 is incremented (Step 726) and the next successive word in RAM 142 is located into ACC1 (Step 706) for processing.

The foregoing sequence continues until all of the data pertaining to the revolution has been processed. Upon sensing an end-to-revolution delimiter, either in Step 710 or Step 728, the instantaneous contents of pointer P2, indicative of the location of the last entry in MILTBL 158, is loaded into the ENDMLM register 160 in RAM 152 (Step 730, and the program proceeds to execute the step of finding and verifying the diamond shape of the marks reflected in the MILTBL 158.

Figure 8:
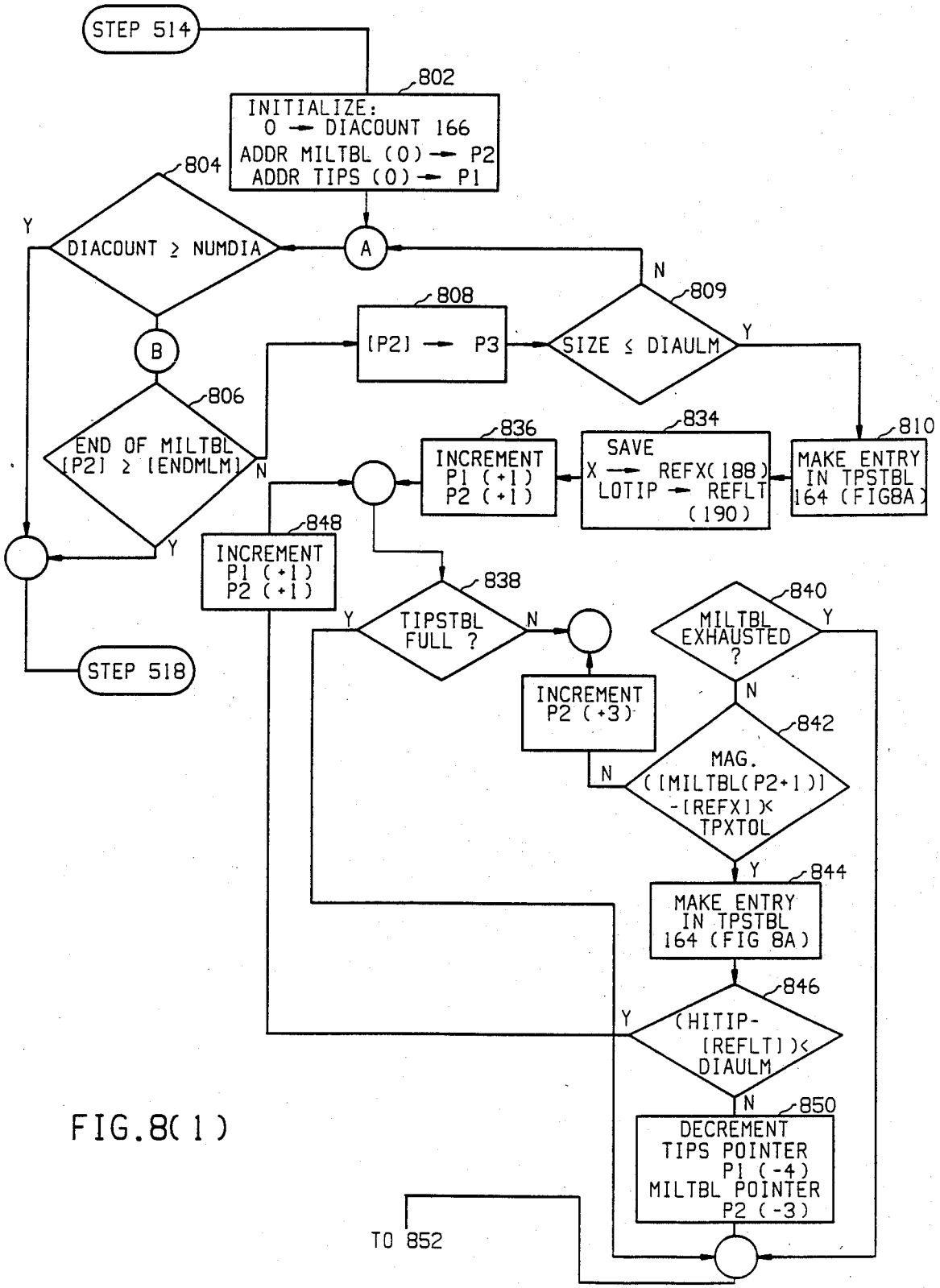
FIGS. 8, 8A, 8B, 8C, 8D and 8E comprise a flow chart of the find/verify diamond shape and size step.
Figure 8:
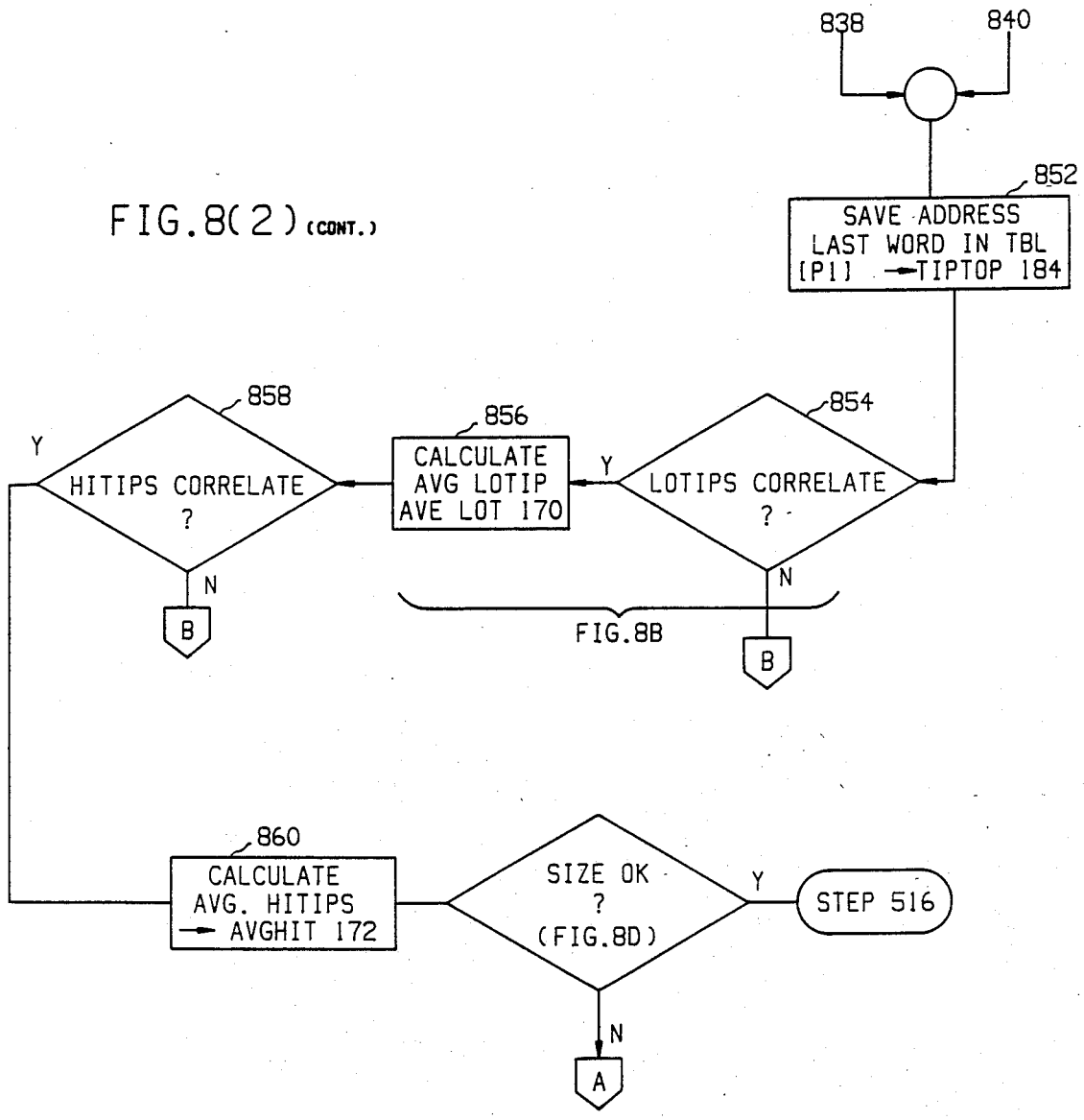

Referring now to FIGS. 1, 1A, and 8A–8E and particularly to FIGS. 8 and 1A, in carrying out the find/verify diamond shape procedure of Step 514, and initialization step (Step 802) is first undertaken. DIACOUNT register 166 in RAM 152 is cleared to 0. The address of the first location in MILTBL 158 (i.e., MILTBL (0)) is loaded into pointer P2. The address of the first location in Tips Table 164 (i.e. TIPS (0)) is loaded into pointer P1.

Each entry in MILTBL 158 is processed in sequence to identify pairs of transitions associated with individual registration marks (which meet the criteria for the valid diamond shape. The expected number of marks, e.g., diamonds (NUMDIA 156) is entered by the operator, and contained in RAM 152. Accordingly, preliminary test (Step 517) are performed to learn whether the expected number of diamonds have been located (Step 804) or the end of the data in MILTBL 158 has been reached (Step 806). Either event signifies completion of the find/verify diamond shape (Step 514) and the program proceeds to determine the coordinates, (Step 518). More specifically, the count of diamond-shaped marks observed as reflected in the DIACOUNT register is compared to the NUMDIA constant (indicative of the expected number of diamonds) from RAM 152 (Step 804). If the expected number of diamonds have not yet been found, the contents of pointer P2 (the location in MILTBL of the entry currently being processed), is compared to the contents of ENDMIL register 160, i.e., indicative of the address of the last entry in MILTBL 158.

Assuming that the end of MILTBL 158 has not been reached, the address of the entry in MILTBL 158 currently being processed (i.e., the contents of pointer P2) is saved in pointer register P3 (Step 808) and a preliminary size check is performed (Step 809). Specifically, the size value from the MILTBL entry (the contents of the location designated by the contents of pointer P2 plus 2) is compared against a predetermined upper limit on diamond size (DIAULM, contained in ROM 150).

Assuming that the size reflected in the MILTBL entry is within limits, and initial entry corresponding to the MILTBL entry is made in TIPSTBL 164. As noted above, TIPSTBL 164 is a fixed-size array of 200 locations, having four-word data sets (X center, low tip, high tip, back-link to the corresponding entry in MILTBL) for each MILTBL entry that meets certain correlation criteria.

Figure 8A:
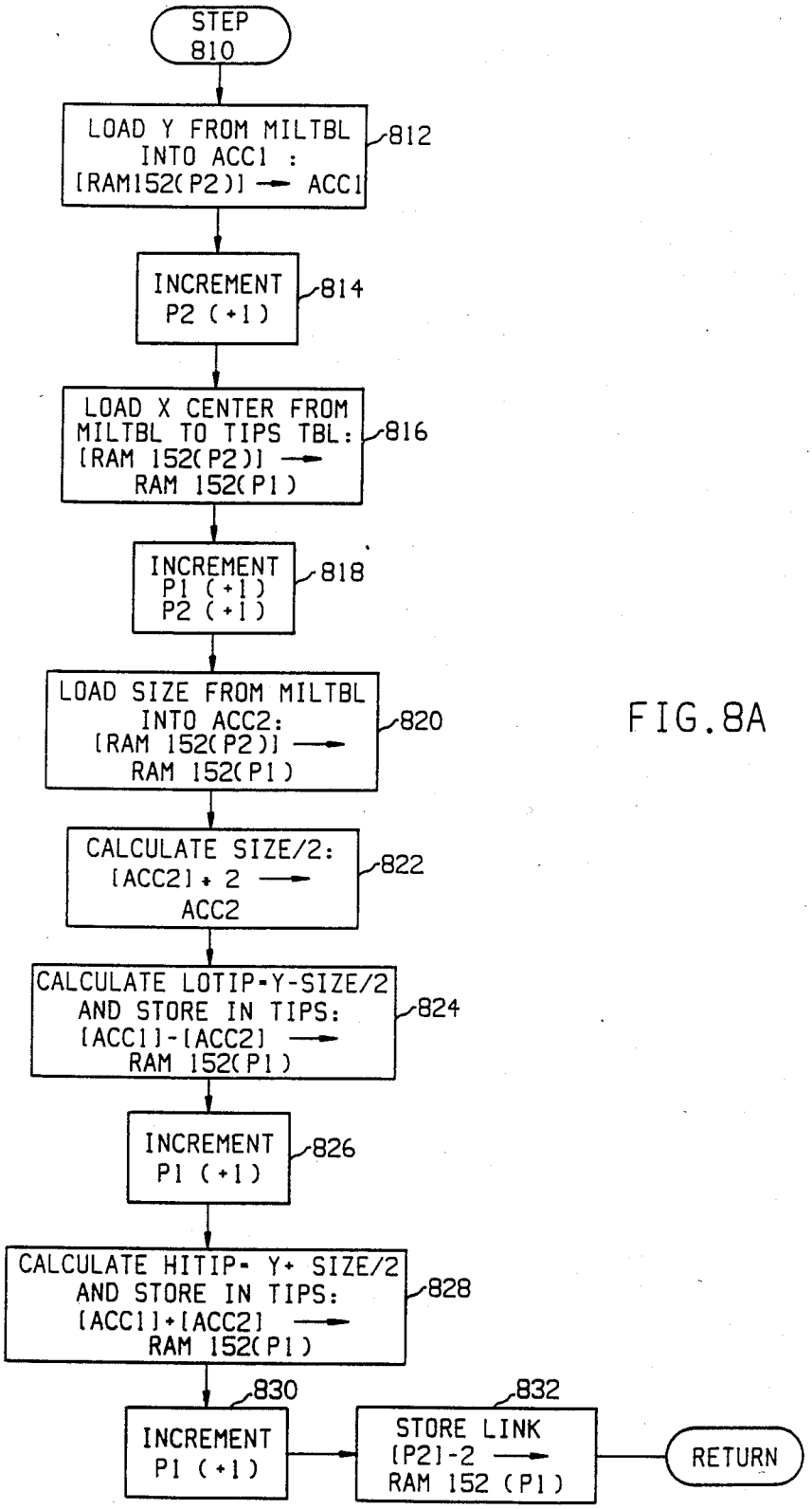

Referring briefly to FIG. 8A, a TIPSTBL entry is generated by first loading the Y value from the corresponding entry in MILTBL 158 into accumulator ACC1. The contents of the location in RAM 152 designated by the address in pointer P2 is loaded into accumulator ACC1 (Step 812). Pointer P2 is then incremented by 1 to designate the next successive location in MILTBL 158, containing the X center location of the transition pair (Step 814). The X center data from MILTBL 158 is then loaded into the second word of the TIPSTBL entry. The X value contained in the location of MILTBL 158 of RAM 152 designated by pointer P2 is loaded into the location of TIPSTBL 164 designated by pointer P1 (Step 816).

Projected Y coordinates of the respective tips of the mark (i.e., the values LOTIP, HITIP) are then calculated and loaded into the next succeeding locations in TIPSTBL 164. As previously noted, in the preferred embodiment the register marks are in the shape of a right-angle diamond, i.e., a square rotated 45 degrees. Accordingly, the distance from the center of the diamond to each apex (tip) of the diamond is equal. Moreover, the distance along a line parallel to the axis from any point along the edge of the diamond to the Y axis is equal to the distance from the intersection with the centerline to the closest Y tip.

Referring briefly to FIG. 2A, a diamond-shaped register mark, for example, mark 202, is scanned by line 207, resulting in a light-to-dark transition at point 208 and dark-to-light transition at point 210. Since diamond 202 is symmetrical, the center point between points 208 and 210 is the X center of the mark. Further, since the diamond is a right-angle diamond, the distance from point 208 to the X centerline is equal to the distance from that point on the X centerline to the low tip 212.

The Y coordinate of the diamond low tip (LOTIP) is calculated by determining the Y coordinate of the scan at issue and subtracting one-half of the size of the transition pair. Similarly, the Y coordinate of the high tip (HITIP0) is calculated as the Y coordinate of the scan plus one-half the size of the transition. It should be recognized, however, that, with respect to scans on the low tip side of the center of the diamond, the high tip calculation will not provide useful data and, with respect to scans on the high tip side of the Y center, the low tip calculation will not provide useful data. However, since the disposition of the particular scan with respect to the Y center of the diamond is undetermined, both high tip and low tip calculations are performed for each scan, and the meaningless calculations are discriminated against in subsequent steps.

Referring again to FIG. 8A, to calculate the high tip and low tip values, pointers P1 and P2 are each incremented by 1 to designate the next open location in TIPSTBL 164, and the size entry for the current transition pair in MILTBL 158 (Step 818). The size value in the location in MILTBL 158 designated by pointer P2 is then loaded into accumulator ACC2 in CPU 144 (Step 820). The value of one-half the size is then calculated (Step 822); the contents of accumulator ACC2 is divided by 2 and reloaded into accumulator ACC2.

The value of LOTIP (the projected Y coordinate of the low tip) is then calculated by subtracting the SIZE/2 value from the Y value of the scan (Step 824). Recalling that the Y value from MILTBL 158 was previously loaded into accumulator ACC1, the contents of accumulator ACC2 is subtracted from the contents of accumulator ACC1 and loaded into the location in TIPSTBL 164 designated by pointer P1.

The HITIP value (the projected Y coordinate of the high tip) is then calculated and loaded into the next successive location in TIPSTBL. Counter P1 is incremented by one to designate the next successive TIPS location (Step 826.) The HITIP value is then calculated by adding the contents of accumulator ACC1 and accumulator ACC2 and loading the sum into the TIPSTBL location designated by pointer P1 (Step 828).

The link to the corresponding MILTBL entry is then generated and stored as part of the entry in TIPSTBL 164. Specifically, pointer P1 is incremented to designate the next successive location in TIPSTBL 164 (Step 830). The link (the address of the first word of the corresponding MILTBL entry) is then calculated by subtracting 2 from the present contents of pointer P2, and the value loaded into the TIPSTBL location designated by pointer P1 (Step 832).

A TIPS entry comprising a 16-bit X center value, a 16-bit word indicative of the Y coordinate of the low tip, a 16-bit word indicative of the Y coordinate of high tip, and a 16-bit word containing the address of the corresponding MILTBL entry is thus generated, and the program proceeds with the next successive step.

Referring again to FIG. 8, after the initial entry in TIPSTBL 164 is generated (Step 810), the X value and LOTIP value from that entry are stored in REFX register 188 and REFT register 190 in RAM 152, respectively (Step 834). As will hereinafter be explained, the reference values are used for discrimination against non-correlating entries.

After the REFX and LOTIP values are saved, pointers P1 and P2 are each incremented by one to designate the first word of the next successive entries in TIPSTBL 164 and MILTBL 158, respectively (Step 836).

Checks are made to ensure that the TIPSTBL is not full (Step 838) and that the MILTBL is not exhausted (Step 840). Assuming that those tests are passed, a preliminary correlation check against the reference entry (Step 842) is then performed with respect to the MILTBL entry to ensure that all entries in TIPS table 164 relate to the same mark. To correlate the magnitude of the deviation of the MILTBL X value from the reference X value, the data in REFX register 188 must be less than a predetermined value (TPXTOL in ROM 150, e.g., 9 mils). If the current MILTBL entry X value deviates by more than the permissible limit, counter P2 is incremented by three to designate the first word of the next successive MILTBL entry (Step 843) and, if MILTBL 158 is not exhausted (Step 840), the X center deviation test (Step 842) is repeated on that MILTBL entry.

When a MILTBL entry is found with an X center that correlates with the reference value (Step 842), a TIPSTBL entry corresponding to that MILTBL entry is made (Step 844) in a manner identical to that described in connection with Step 810.

After the TIPS table entry has been made, a correlation test between the new TIPS entry and the reference TIPS entry is then effected (Step 846). If the reference entry and new entry both relate to the same diamond, the Y coordinate of the diamond high tip, represented by the value of HITIP in the new entry, will be disposed no more than predetermined maximum distance from the Y coordinate of the diamond low tip, represented by the LOTIP reference value. The value of HITIP in the new entry minus the reference LOTIP is tested against a predetermined maximum (DIAULM in ROM 150, e.g., 156 mils). If the new entry correlates with the reference, pointers P1 and P2 are each incremented by one to designate the next open location TIPTBL 164 and the next successive MIL table entry for processing, respectively (Step 848), and Steps 838–848 are then repeated.

The TIPS table generation process is continued until a TIPS entry fails the diamond length correlation test (Step 846), TIPS table 164 is filled (Step 838) or MILTBL 158 is exhausted (Step 840). Exit is typically effected upon the failure of a TIPS entry to meet the diamond length correlation test (Step 846), indicating that the entry is not associated with the same diamond as the reference entry, but is, perhaps, associated with the next successive diamond. Accordingly, under such circumstances, pointer P1 is decremented by four to point to the last word of the previous TIPS entry, and MIL table pointer P2 is decremented by three to point to the last entry of the previous MILTBL entry (Step 850). Accordingly, the non-correlating TIPS entry is effectively disenfranchised, and will be overwritten in the processing of the next diamond. Decrementing pointer P2 ensures that the corresponding MIL table entry is processed in connection with the next diamond.

After a TIPS table has been generated for an observed mark, the address of the last word in TIPSTBL 164 (in Pointer P1) is then stored in TIPTOP register 184 in RAM 152 (Step 852), and the program proceeds with further correlation steps to ensure that all entries in TIPTBL 164 relate to the same valid diamond shape.

A low tip correlation test (854) is effected. The LOTIP values of the respective entries in TIPSTBL 164 are compared with the first entry in the table to ensure that all entries indicate within predetermined limits the same Y coordinate for the diamond low tip. If sufficient correlation is reflected, an average low tip value is calculated and stored in AVGLOT register 170 (Step 856). If the low tips do not reflect sufficient correlation, TIPSTBL 164 is regenerated, using the second scan (i.e., second entry in MILTBL 158) rather than the first scan as the source for the X reference and LOTIP reference values. Steps 854 and 856 will be hereinafter more fully described in conjunction with FIG. 8B.

Assuming low tip correlation, a similar correlation test is performed with respect to the HITIP values of the entries in TIPSTBL 164 (Step 858). If sufficient correlation is found between the HITIP values and the reference HITIP value stored in REFHT Register 192, an average HITIP value is calculated and stored in AVGHIT Register 172 in RAM 152. Steps 858 and 860 will be described more fully in conjunction with FIG. 8C.

After the average HITIP value has been stored in the AVGHIT register 172, a size correlation test is performed, (Step 861). Size correlation Step 861 will be more fully described in connection with FIG. 8D. If the diamond size is within predetermined limits, the program proceeds to calculate X and Y center values (Step 516). If, however, the size of the mark is outside the predetermined limits for a diamond, the data in MILTBL 158 corresponding to the mark is discriminated against and a return is made to point B.

Figure 8B:
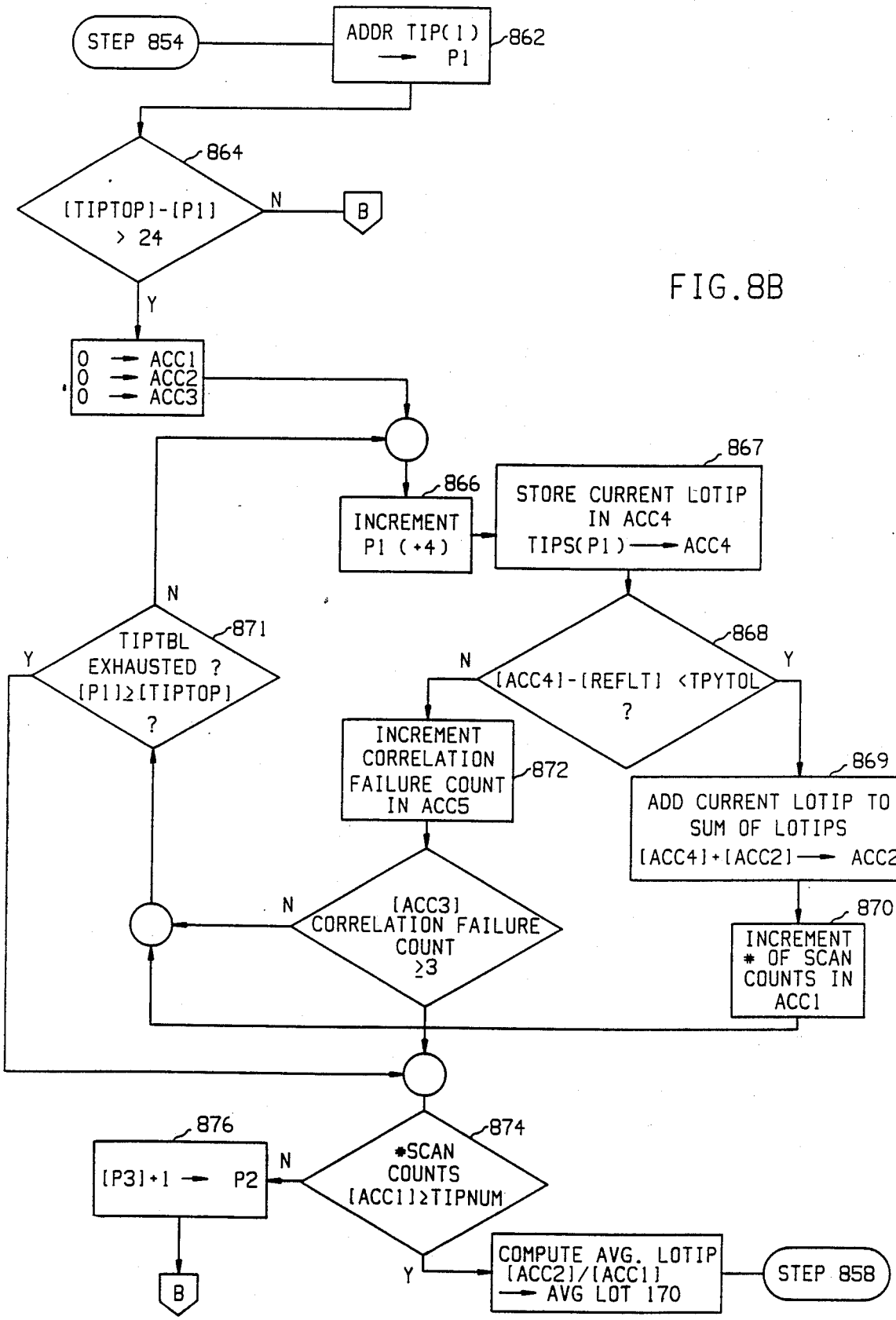

Referring now to FIG. 8B, upon initiation of the low TIPS correlation step (Step 854), the address of the first LOTIP value in TIPSTBL 164, i.e., the address of TIPTBL (1), is loaded into pointer P1 (Step 862).

An initial test (Step 864) is made to ensure that there are a sufficient number of entries (e.g., 6) in TIPSTBL 164. Specifically, the contents of pointer P1 (indicative of the address of the first LOTIP value) is subtracted from the contents of TIPTOP register 184 (the address of the last entry in the table). If the difference is not greater than 24 (6 entries times 4 words per entry), the mark reflected in the TIPS table is deemed not to be a proper diamond, and an exit is made to point B in FIG. 8, to effect generation of a TIPSTBL for the next successive mark reflected in MILTBL 158.

Assuming, however, that there are at least six entries in the TIPSTBL, accumulators ACC1, ACC2, and ACC3 in CPU 144 are initialized to zero (Step 865). Accumulator ACC1 is used to count the number of scans correlating with the reference LOTIP. Accumulator ACC2 is utilized for averaging the values of the LOTIPs meeting the correlation criteria. Accumulator ACC3 is used to maintain a count of correlation failures. A fourth accumulator, ACC4, in CPU 144 is used to store the LOTIP value of the current entry.

The value of each successive LOTIP entry is then correlated against the reference LOTIP value in REFLT register 190. Specifically, pointer P1 is incremented by four to designate the LOTIP value of the next successive entry in TIPSTBL 164 (Step 866). The LOTIP value in the location specified by pointer P1 is then stored in accumulator ACC4 (Step 867). A LOTIP correlation test is then made (Step 868); the magnitude of the difference between the tested LOTIP value and the reference LOTIP value must be less than a predetermined constant (TPYTOL in RAM 150, e.g., 3 mils).

If the deviation of the tested LOTIP is within permissible limits of the reference value, the LOTIP value in ACC4 is added to the sum of LOTIPs maintained in accumulator ACC2 (Step 869). The number of correlating scans count in accumulator ACC1 is then incremented (Step 870) and, assuming that the TIPS table is not exhausted (Step 871), pointer P1 is again incremented by four to access the next successive LOTIP value for processing (Step 866).

If, however, the current LOTIP value in ACC4 deviates from the reference by more than the permissible amount, the correlation failure count in ACC3 is incremented (Step 872), and a test is made to ensure that the number of correlation failures does not exceed a predetermined amount (e.g., 3 ) (Step 873).

If the correlation failure count does not exceed the predetermined number, the contents of pointer P1 (the address of the current LOTIP value) is compared against the contents of TIPTOP register 184 (the address of the last entry in the table) to determine whether the TIPSTBL is exhausted (Step 871) and the LOTIP value of the next entry in TIPSTBL 164 is accessed by incrementing pointer P1 by four (Step 866).

The correlation cycle continues until either the correlation failure count in accumulator ACC3 exceeds the predetermined limit (e.g., 3) (Step 873) or the TIPS table is exhausted (Step 871). It is expected that exit from the loop will occur as a result of correlation failure; entries corresponding to scan lines on the high side of the Y center will not include LOTIP value relating to the actual diamond low tips and correlation failure will typically occur within a few scans after reaching the Y center. After the sum of the LOTIP values correlating with the low tip (as established by the reference LOTIP value) is established, the number of correlating scans count in accumulator ACC1 is tested against a predetermined minimum number (TIPNUM in ROM 150, e.g., 3) to ensure that a sufficient number of scans indicated the same Y coordinate (within correlating low tips (Step 874)). Assuming that the minimum number of correlating scans is exceeded, the average LOTIP value is computed and stored in AVGLOT a register 170 in RAM 152 (Step 856). The average is computed by dividing the cumulative sum of the correlating LOTIP values in ACC2 by the contents of the number of correlating scans count in ACC1.

If, however, the number of correlating scans is less than the minimum permissible value, the TIPSTBL is regenerated using a different reference value, e.g., the second entry in MILTBL 158. Thus, if the failure to correlate was due to an improvident choice of reference value (i.e., a reference value which itself does not correlate with the actual low tip of the diamond), the regeneration of the TIPSTBL in connection with a different reference entry may provide for correlation. Accordingly, the contents of pointer P3 (address of the MILTBL entry corresponding to the reference values), plus 1 is loaded into pointer P2 to designate the next successive MILTBL entry for processing (Step 876), and processing is resumed at point B in FIG. 8 for regeneration of the TIPSTBL in connection with the new reference.

Figure 8C:
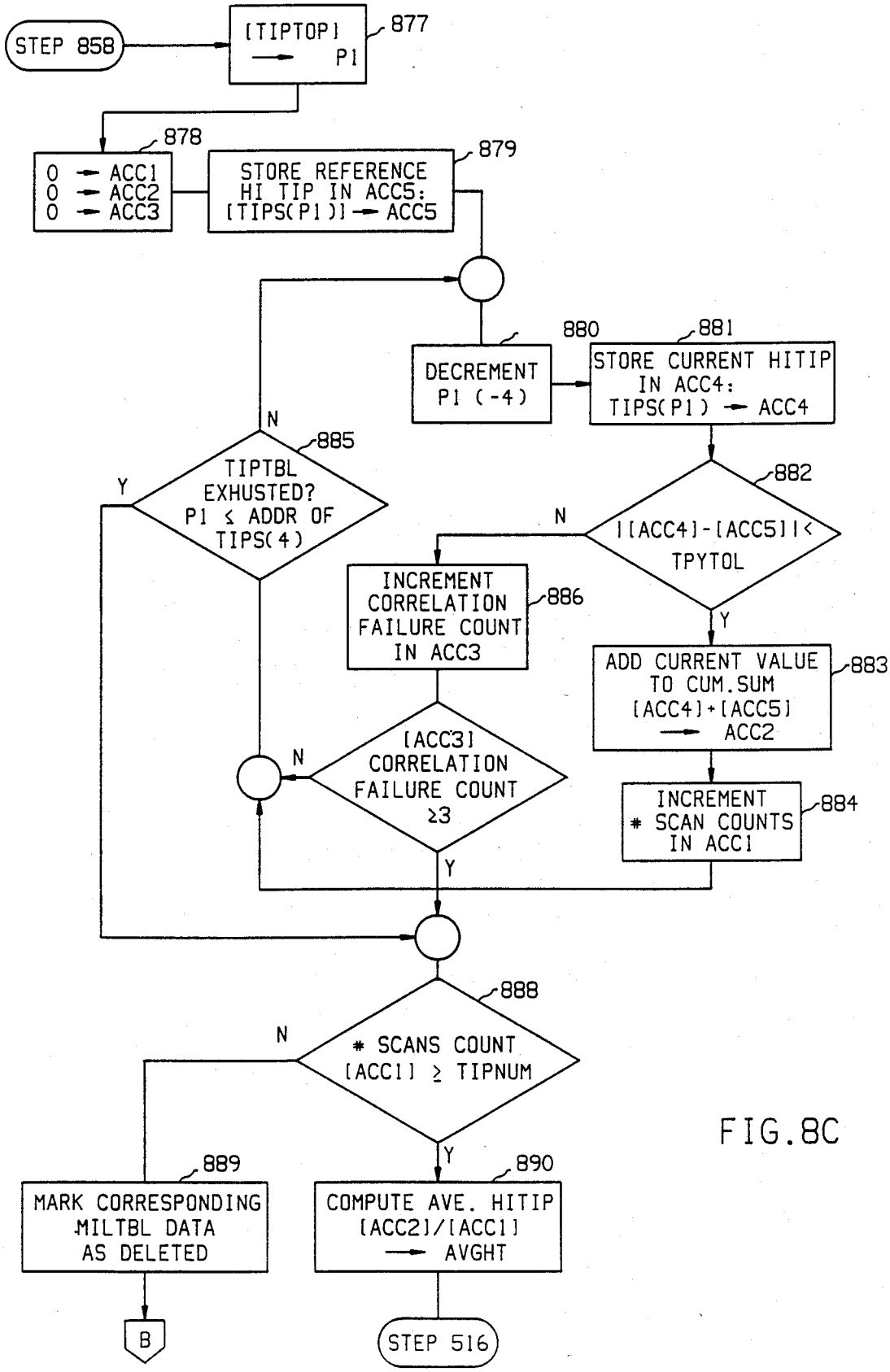

After an average LOTIP value is loaded into the AVGLOT register 170, the program performs the HITIP correlation test (858). Referring to FIG. 8C, step 858 is initiated by loading the contents of TIPTOP register 184 (indicative of the last data location in TIPSTBL 164) into pointer P1, and clearing accumulators ACC1, ACC2 and ACC3 (Step 878). A HITIP reference value, preferably the HITIP value from the last entry in table 164, designated by pointer P1, is then established in accumulator ACC5 in CPU 144 (Step 879).

Pointer P1 is then decremented by four to designate the HITIPs value in the next preceeding entry in TIPSTBL 164 (Step 880). The designated HITIP value is then stored in accumulator ACC4 (Step 881).

The correlation test (Step 882) is then effected; the magnitude of the difference between the contents of accumulator ACC4 (current HITIP value), and accumulator ACC5 (REFHT value) is tested against the predetermined limit TPYTOL in ROM 150 (e.g., 3 mils). If the current value correlates with the reference, it is added to the cumulative sum in accumulator ACC2 (Step 883), and the number of correlating scans count in accumulator ACC1 is incremented (Step 884). Assuming that the TIPSTBL is not exhausted (Step 885), pointer P1 is again decremented by four to designate the HITIP value of the next preceeding entry in TIPSTBL 164 for processing (Step 880).

As with respect to the LOTIP correlation (Step 854), when the current HITIP value deviates beyond permissible limits from the reference value, the correlation failure count in accumulator ACC3 is incremented (Step 886), and the number of correlation failures is tested (Step 887). If the correlation failure count in accumulator ACC3 is within permissible limits, counter P1 is checked against the address of TIPS 4 (the address of the second entry in table 164) to determine if the TIPSTBL has been exhausted. If not, pointer P1 is again decremented by four to designate the next preceding HITIP value for processing (Step 880).

The HITIP correlation sequence continues until either the correlation failure count exceeds the predetermined limit (Step 887) or the TIPS table is exhausted (Step 885). A correlation count failure is expected once entries are accessed corresponding to scans on the low side of the Y center of the mark.

As in the case of the LOTIP correlation (Step 854), the number of correlating scans in accumulator ACC1 is tested against the predetermined number (e.g., 3) to ensure that the table contains at least the minimum number of correlating scans (Step 888). If the requisite number of correlating scans is not contained in the table, each entry in the MILTBL 158 corresponding to the present entries in TIPSTBL 164 is worked with a discriminant (or zeroed) to prevent use in further processing (Step 889), and a return to point B in FIG. 8 is made to effect generation of a TIPSTBL 164 for the next word reflected in MILTBL 158. The procedure for marking the table data as deleted will be described in conjunction with FIG. 8E.

Assuming, however, that the requisite number of correlating scans is found, the average HITIP value is then calculated by dividing the cumulative sum of correlating HITIP values in ACC2 by the number of correlating scans in ACC1. The average value is then loaded into the AVGHIT register 172 and RAM 152 (Step 860), and the size correlation test (Step 861) is executed.

Figure 8D:
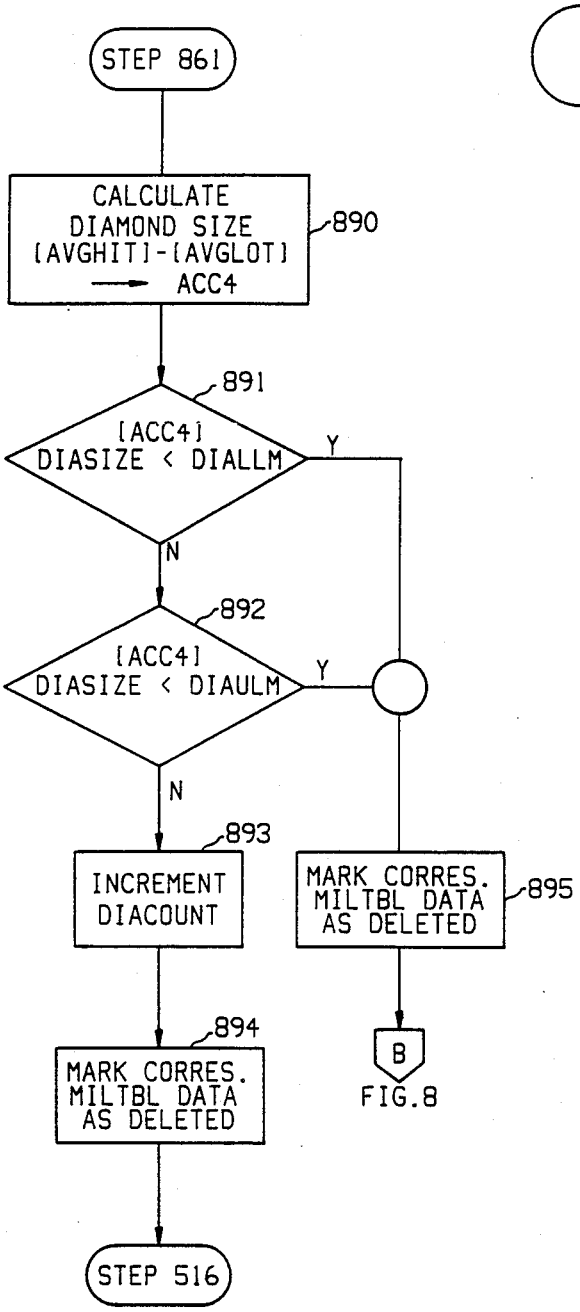
Figure 8E:
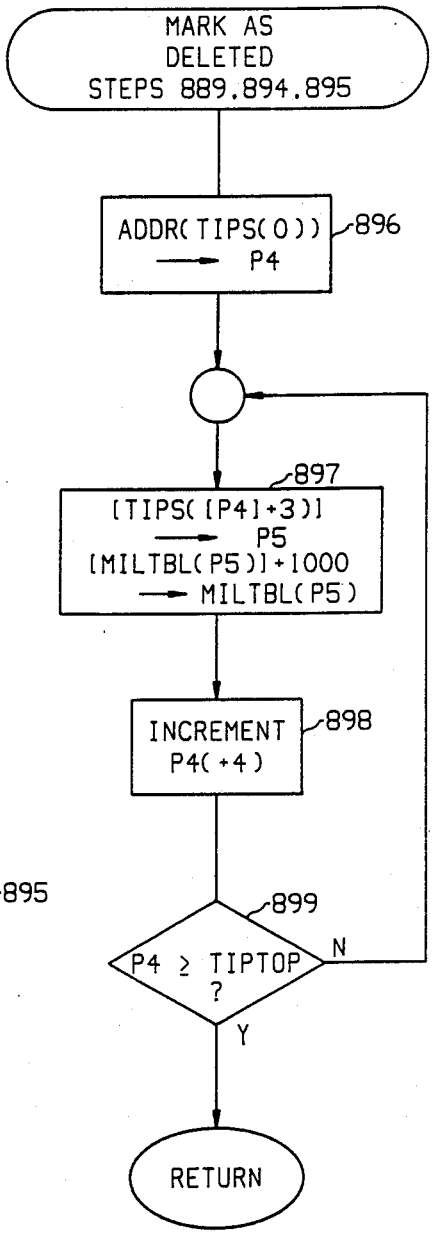

Referring now to FIG. 8D, the size correlation check (Step 861) is initiated by first calculating the diamond size (the average HITIP value in AVGHIT register 172, minus the average LOTIP value in the AVGLOT register 170) and loading the diamond size value into ACC4 in CPU 144 (Step 890). The calculated diamond size is then compared (Step 891) against a predetermined lower size limit (DIALLM in ROM 150, e.g., 90 mils). Assuming the diamond size value in ACC4 is greater than the lower limit, it is then tested (Step 892) against a predetermined upper limit for diamond size (DIAULM in ROM 150, e.g., 156 mils).

Assuming that the diamond size in ACC4 passes both the lower and upper limits tests, the diamond count in the DIACOUNT register 166 in RAM 152 is incremented. The data in MILTBL 158 relating to the TIPSTBL entries corresponding to the observed diamond is then marked as deleted (Step 894).

If the diamond size value in accumulator ACC4 is less than the lower limit or greater than the upper limit (Steps 891, 892), the MILTBL data corresponding to the diamond is marked as deleted (Step 895), and a return to point B in FIG. 8 is made (without incrementing DIACOUNT register 166) and a TIPSTBL generated for the next word reflected in MILTBL 158.

MILTBL data is preferably marked as deleted (Steps 889, 894 and 895) by adding a large predetermined value to the X values of the respective entries in MILTBL 158 corresponding the contents of the particular TIPSTBL at issue. The predetermined value is chosen to be large enough to ensure that the X value exceeds various size tests and, thus, effectively deletes the data from further consideration. If desired, the respective X values can be set to zero. However, for diagnostic purposes, it may be desirable to retain indicia of the original data. Specifically, referring to FIG. 8E, pointer P4 in CPU 144 is loaded with the address of the X value of the first entry in TIPSTBL 164 (Step 896). The link address contained in the TIPSTBL entry at issue (the location of RAM 152 designated by the contents of pointer P4 plus 3), is loaded into Pointer P5. Pointer P5 thus contains the address of the MILTBL X center entry corresponding to the TIPS entry at issue. The predetermined constant, e.g., 1000, is then added to MILTBL X value (in the RAM 152 location designated by Pointer P5) and the sum stored back into the MILTBL location (step 897).

Pointer P4 is then incremented by four to designate the next entry in TIPSTBL 164 (Step 898). A test is performed to determine if the TIPSTBL is exhausted (Step 899) (the contents of pointer P4 is compared against the address of the last entry in TIPSTBL 164 contained in TIPTOP register 184). If the TIPSTBL is not exhausted, Steps 897, 898 and 899 are repeated for the next successive TIPS entry, identified by pointer P4. This process continues until TIPSTBL 164 is exhausted (Step 899), whereupon a return to the next program step is effected.

Figure 9:
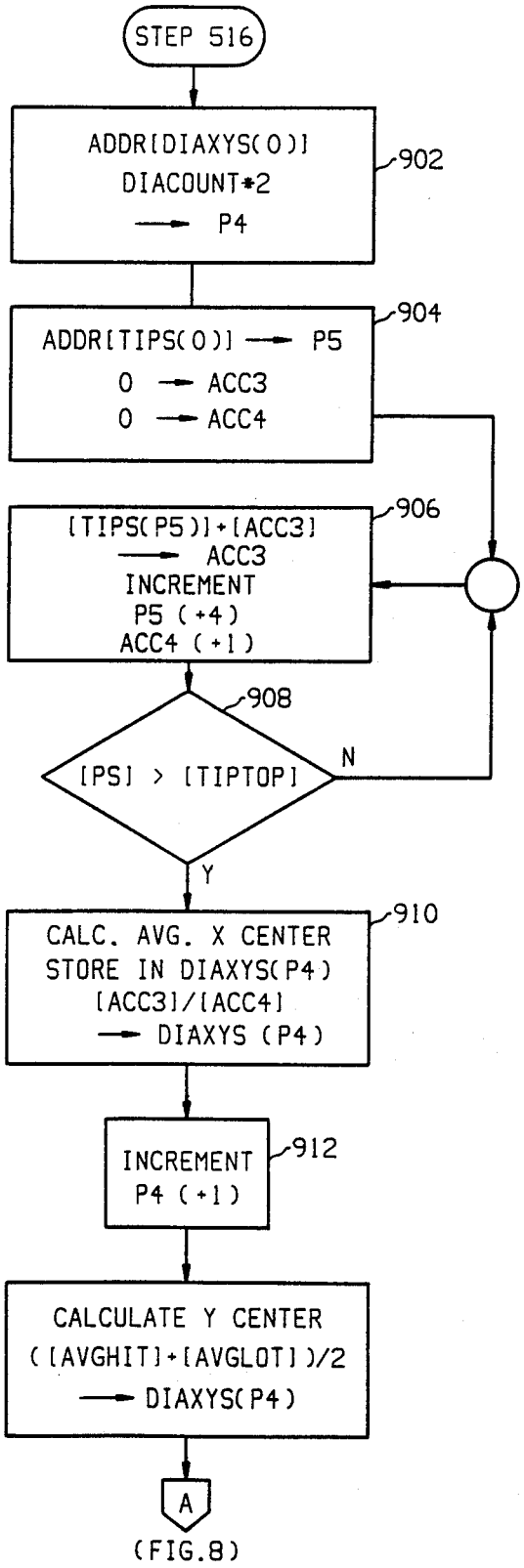
FIG. 9 is a flow chart of the determine coordinates of diamond center step.

Once a mark is found to correlate with the predetermined diamond criteria indicia of the nominal center coordinates of the mark, e.g., the X and Y coordinates of the center of the diamond, are calculated and indicia stored in a corresponding two-word entry (X,Y) in DIAXYS table 178 of RAM 152 (Step 516). In effect, the center of the area defined by the transition associated with the mark is determined. More specifically, referring now in FIG. 9, the address of the first location of the DIAXYS table plus twice the current diamond count is loaded into pointer P4, to designate the first open location in DIAXYS table 178 (Step 902). The address of the first location in TIPSTBL 164 is loaded into pointer P5 and respective accumulators ACC3 and ACC4 are set to zero (Step 904). Accumulator ACC3 is used to maintain a cumulative sum of the X center values from the TIPSTBL 164. Accumulator ACC4 is used to maintain a running count of the number of TIPSTBL entries processed.

The accumulated sum of X values in TIPSTBL 164 is first established in ACC3. The contents of the TIPSTBL location designated by pointer P5 (initially the first X value, TIPSTBL (0)), is added to the contents of ACC3, and the sum loaded into ACC3. Pointer P5 is then incremented by four to designate the next successive X value in TIPSTBL 164 and the number of entries count in ACC4 is incremented by one (Step 906). The contents of pointer P5 are then tested against the contents of TIPTOP register 184 to determine whether the TIPSTBL 164 has been exhausted. If not, the X value designated by pointer P5 is added to the cumulative sum in ACC3, and pointers P5 and ACC4 are again incremented (Step 906). The summing process is continued until it is determined that the TIPSTBL 164 is exhausted (Step 908).

After the sum of all X values in TIPSTBL 164 has been accumulated, the average value of the X center is calculated and stored in the location of DIAXYS table 178 designated by Pointer P4. Specifically, the cumulative sum in accumulator ACC3 is divided by the number of entries count in accumulator ACC4 and loaded into the located of DIAXYS table 178 (step 910).

The y coordinate of the diamond center is then determined and stored in the next DIAXYS location. Counter P4 is incremented by one to designate the next successive location in the DIAXYS table 178. The average Y center value is then calculated by summing the average HITIP value in AVIGHIT register 172 and the average LOTIPS value in the AVGLOT register 170, and dividing the sum by two. The result is loaded into the location of DIAXYS table 178 designated by pointer P4 (Step 914).

After the X and Y center values for the diamond are stored in DIAXYS table 178, a return to the find/verify diamond shape and size step (Step 514) is effected at point A, and if the diamond count is less than the predetermined number NUMDIA (Step 517), the next mark reflected in MILTBL 158 is analyzed for correlation with the predetermined diamond characteristics.

Figure 10:
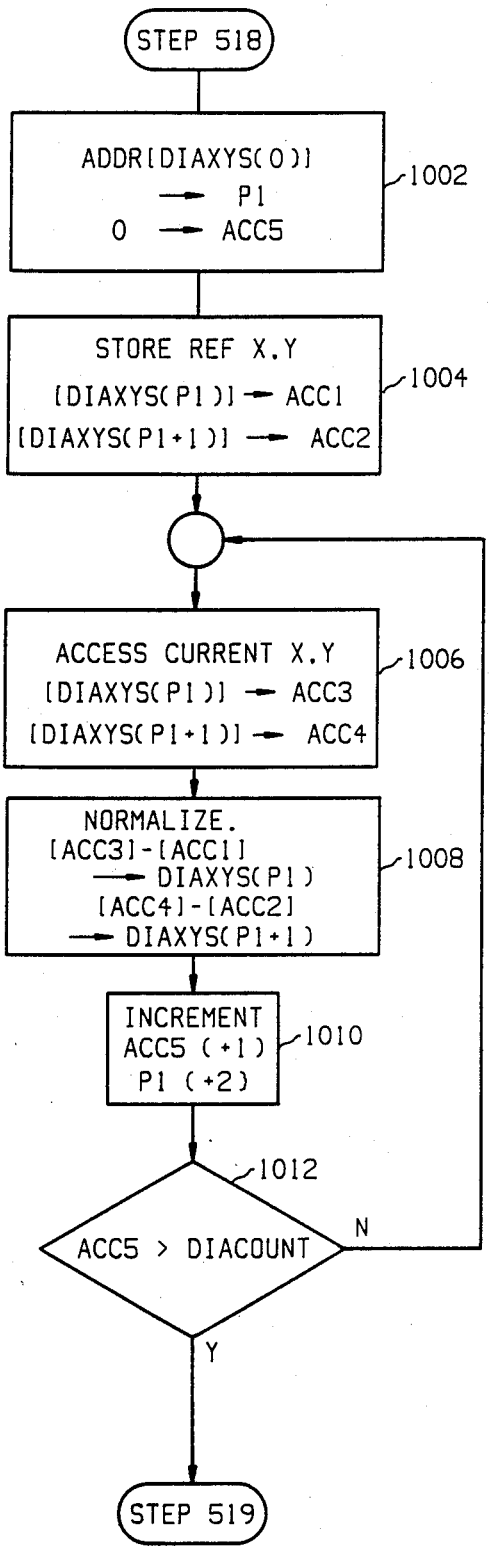
FIG. 10 is a flow chart of the normalize coordinates step.

After the X-Y centers of the diamonds are determined and stored in DIAXYS table 178 for the predetermined expected number of diamonds, or all diamonds reflected in MILTBL 158, the X-Y coordinate values are normalized with respect to the first diamond observed (e.g., reference diamond 202 in FIG. 2) to provide indicia of the relative coordinates of the registration marks. Referring now to FIG. 10, the normalization (Step 518) is achieved by first loading the address of the first element in the DIAXYS table 178 (DIAXYS) (0)) into pointer P1 in CPU 144. The accumulator ACC5 in CPU 144 is cleared to zero for use as a counter. As will be explained, accumulator ACC5 maintains an ongoing count of the number of diamonds normalized (Step 1002).

The X and Y coordinates of the first DIAXYS entry (corresponding to the center coordinates of the first observed diamond) are established as reference coordinates (Step 1004). The X value contained in the first location of DIAXYS table 174 designated by pointer 1 is loaded into accumulator ACC1 in CPU 144. The Y value (in the next successive location of DIAXYS) is loaded into accumulator ACC2.

The X, Y coordinates for the respective diamonds are then normalized. Each DIAXYS entry is accessed in sequence and loaded into accumulators ACC3 and ACC4 in CPU 144 (Step 1006). Specifically, the X value in the DIAXYS location designated by the contents of pointer P1 is loaded into ACC3 and the Y value in the next successive location is loaded into ACC4. In the initial instance, the X and Y values of the first entry in DIAXYS table 178, (corresponding to the reference diamond) are loaded into accumulators ACC3 and ACC4 as well as into accumulators ACC1 and ACC2.

Normalization is then effected (Step 1008). The reference X value in ACC1 is subtracted from the X value in ACC3 and the result loaded into the DIAXYS location identified by pointer P1. Similarly, the Y reference value in ACC2 is subtracted from the current Y value in ACC4 and the result loaded into the next successive DIAXYS location.

The number of diamonds normalized is counted by accumulator ACC5 and is then incremented by one and pointer P1 is incremented by two to designate the beginning of the next entry in DIAXYS table 178 (Step 1010), and a test is made to determine if all diamonds have been processed (Step 1012). If the count of diamonds normalized in accumulator ACC5 is not greater than the count of the number of diamonds observed in DIACOUNT register 166 (Step 1012), Steps 1006, 1008, 1010 and 1012 are repeated for the entry in DIAXYS table 178 now identified by pointer P1. The process is repeated until each entry in DIAXYS table 174 has been normalized. This results in a coordinate system with the first reference diamond at position (0,0).

Figure 11:
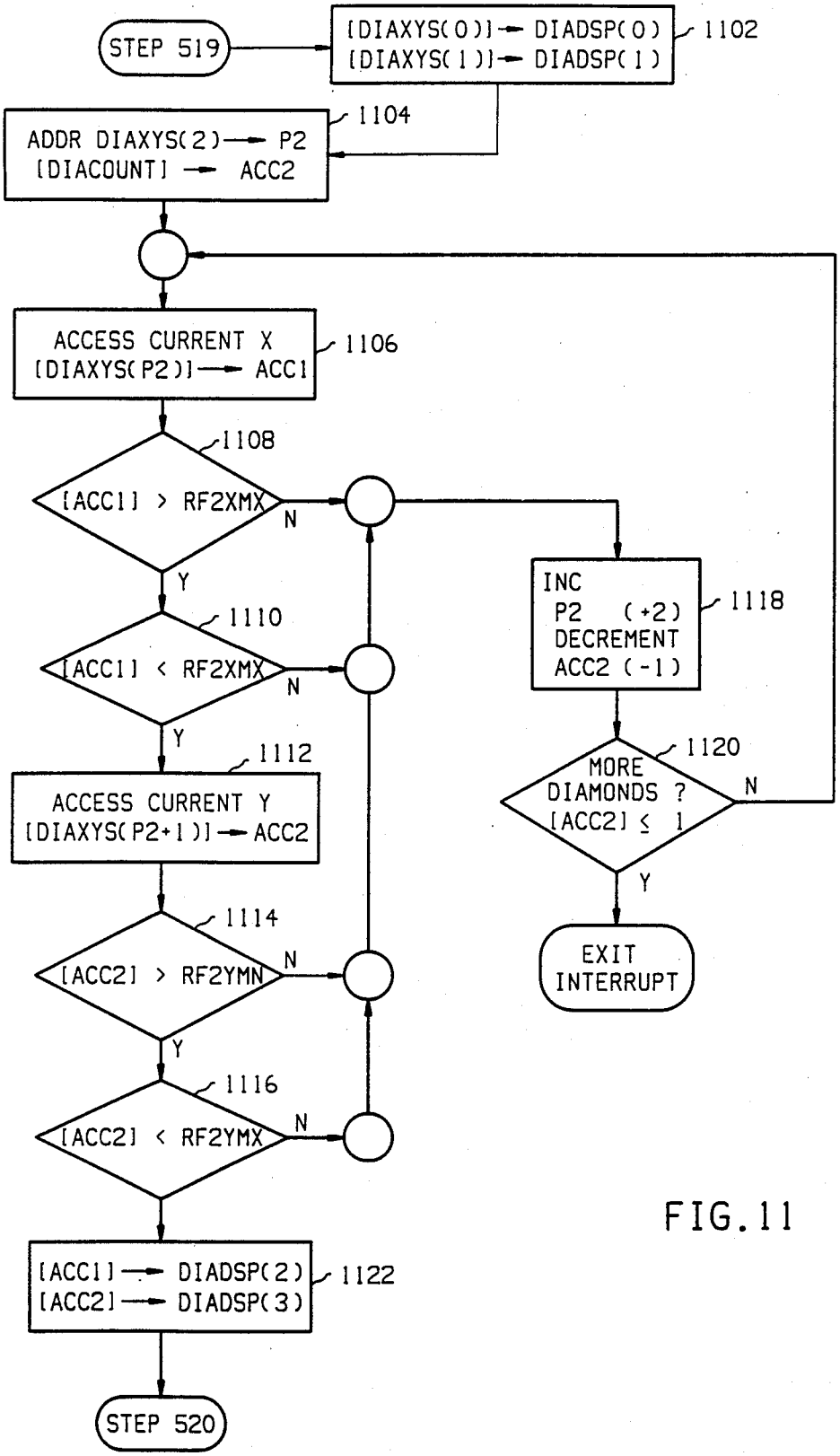
FIG. 11 is a flow chart of the determine second reference step (Step 519)

As previously noted, after the X, Y coordinates are normalized with respect to the first observed diamond, the diamond center coordinates are examined to identify the second reference diamond (Step 519) to facilitate compensation for web weave and web stretch (Step 520). Referring now to FIG. 11, the second reference diamond is identified by comparing the center coordinates of the observed diamonds with predetermined limits: minimum X (RF2XMN in ROM 150), a maximum X position (RF2XMX), minimum Y (RF2YMN), and maximum Y (RF2YMX) distance from the first reference diamond. By way of initialization, the first entry in the DIAXYS (pertaining to the observed first diamond) is accessed and loaded into the first and second locations of the diamond display table (DIADSP) 180 (Step 1102), the beginning address of the second DIAXYS (DIAXYS (2)) is loaded into pointer P2, and the count of observed diamonds from DIACOUNT register 166 is loaded into ACC2 (Step 1104).

The respective diamond centers reflected in DIAXYS 178 are then accessed in sequence and compared against the reference limits. Specifically, the contents of the DIAXYS location identified by pointer P2 is loaded into ACC1 (Step 1106). The X value in ACC1 is then tested against the X position minimum (RF2XMN) (Step 1108) and, if not disqualified, it is tested against the maximum X position (RF2XMX) (Step 1110). If the X value is within the permissible limits, the Y value of the DIAXYS entry (DIAXYS (P2+1)) is accessed and loaded into ACC2 (Step 1112). The Y value is then tested against the Y minimum value (RF2YMN) (Step 1114) and if not eliminated, against the Y maximum value (RF2YMX) (Step 1116). If an X value or Y value is outside permissible limits, pointer P2 is incremented by two to designate the next DIAXYS entry, and the diamonds processed count in ACC2 decremented by one (Step 1118). The count in accumulator ACC2 is checked. to ensure that entries in DIAXYS 178 remain to be checked (Step 1120) and, if the DIAXYS is not exhausted, the DIAXYS entry identified by pointer P2 is accessed and the process is repeated.

The process continues until a center with X, Y coordinates within the predetermined limits is found and deemed to be the second reference diamond, or DIAXYS 178 is exhausted. When a DIAXYS entry corresponding to the reference diamond is found, the contents of ACC1 (indicative of the X value) is loaded into the third location in diamond display register 180 (i.e., DIADSP (2)), and the contents of ACC2 (the Y value) is loaded into the next successive location in the DIADSP 180 (Step 1122).

If DIAXYS 178 is exhausted without finding an entry corresponding to the second reference diamond, the interrupt routine is exited, and, upon the generation of the end-of-revolution signal by counter 140, the data acquisition mode will be reentered to collect a new set of data in RAM 142.

Figure 12:
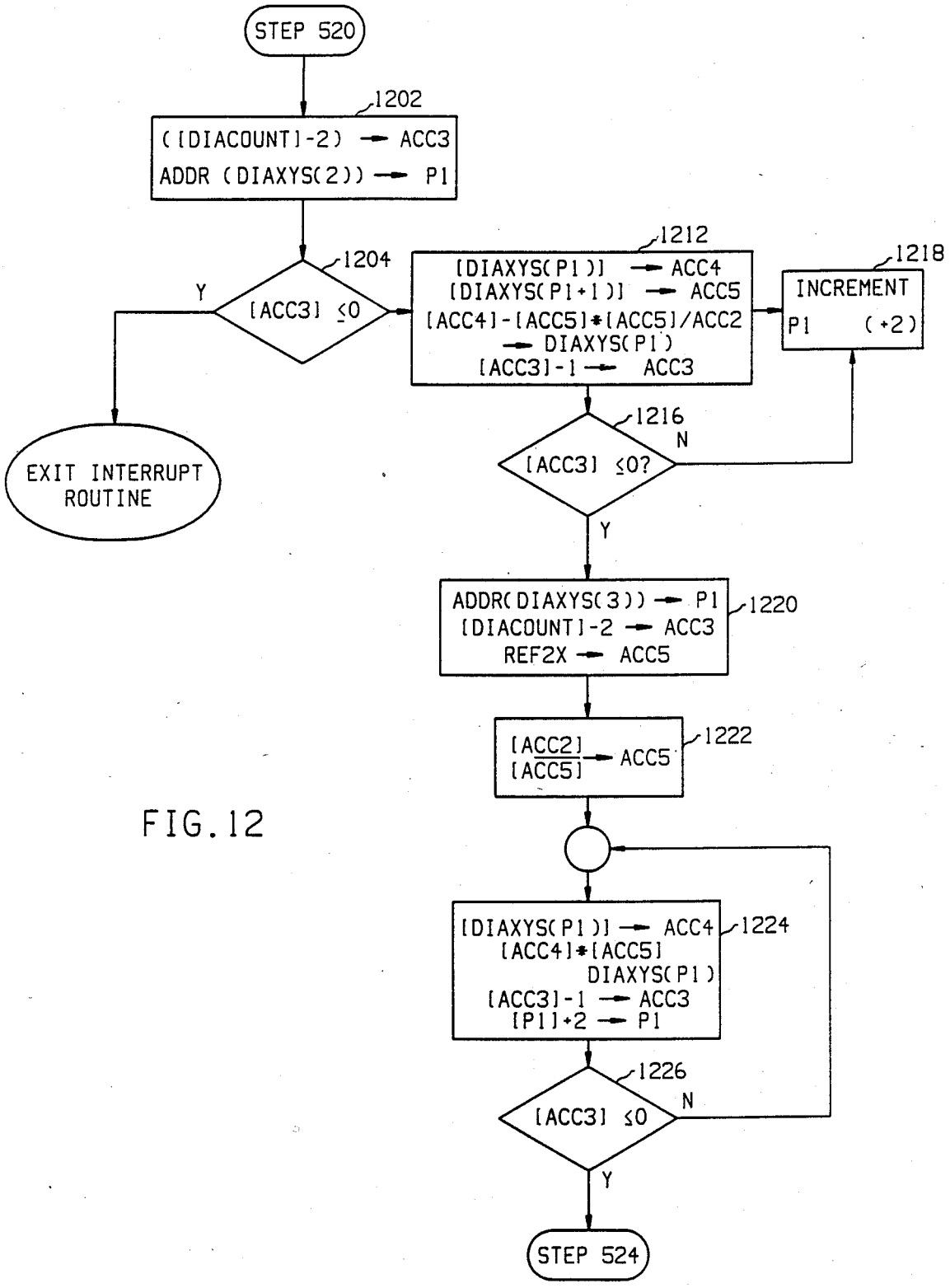
FIG. 12 is a flow chart of the process for web weave/web stretch compensation.

After the center coordinated of the second reference diamond are loaded into the corresponding location in DIAXYS 180, the X and Y coordinates of the centers of the non-reference diamonds are compensated (adjusted) for non-registry related positional deviation. Referring now to FIG. 12, by way of initialization, the number of observed non-reference diamonds (the contents of DIACOUNT register 166 minus 2) is loaded into accumulator ACC3, and the address of the DIAXYS table entry corresponding to the second observed diamond (DIAXYS (2)) is loaded into pointer P1 (Step 1202).

A check (Step 1204) is made to establish that there is at least one non-reference diamond (i.e., that the contents of accumulator ACC3 is greater than zero). If at least one non-reference diamond is not observed, the registry cannot be checked, and accordingly, the interrupt routine is exited and the data acquisition mode operation is repeated upon the next end-of-revolution signal from counter 140.

Figure 12A:
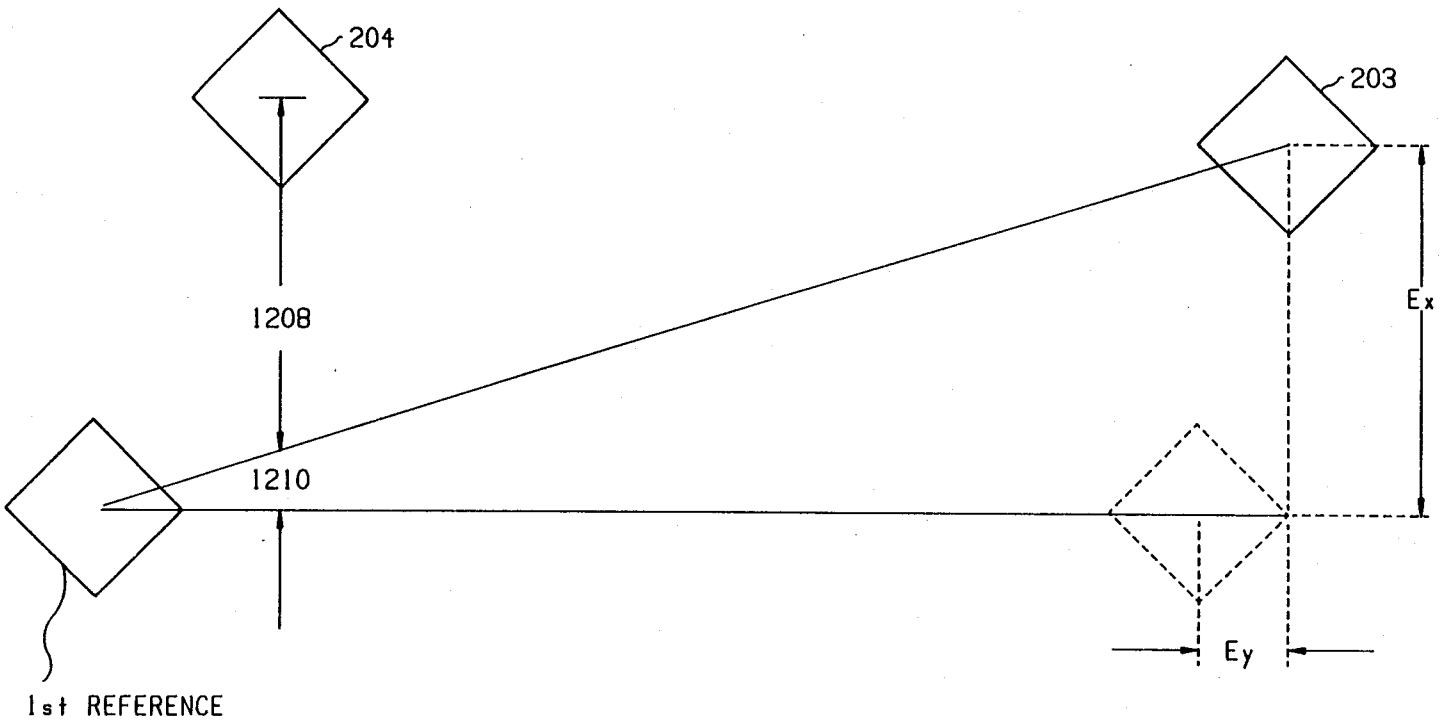
FIG. 12A illustrates the effects of web weave/web stretch on the reference marks.

Assuming that at least one non-reference diamond is observed, the DIAXYS table entries corresponding to the non-reference diamonds are accessed in sequence and the X deviation not due to registry error is compensated for. Specifically, the X coordinate value (the contents of the DIAXYS table location designated by pointer P1) is loaded into accumulator ACC4, and the Y coordinate (in the next succeeding DIAXYS table location) is located in accumulator ACC5. Referring briefly to FIG. 12A, when the center coordinates of the second reference diamond 203 vary from the expected X-Y coordinates by amounts EX and EY, the X deviation perceived with respect to a non-reference diamond 204 will contain a component 1208 due to registry error, but will also contain a component 1210 due to, for example, web weave. In accordance with the law of triangles, the non-registry related X deviation 1210 of diamond 204 can be determined by multiplying the X deviation of reference diamond 203 by the ratio of the Y coordinate of diamond 204 divided by the Y coordinate of reference diamond 203. Accordingly, referring again to FIG. 12, the X coordinate of the second reference diamond contained in accumulator ACC1 is multiplied by the Y coordinate of the non-reference diamond contained in accumulator ACC5, and divided by the Y coordinate of the second reference diamond contained in accumulator ACC2. The non-registry related X deviation component thus calculated is subtracted from the observed X coordinate value of the non-reference diamond in accumulator ACC4, and the result loaded into the DIAXYS table location from which the observed X coordinate was taken (Step 1212).

The number of diamonds processed count in accumulator ACC3 is then decremented by one (Step 1214) and tested against zero (Step 1216) to determine if all of the DIAXYS entries corresponding to non-reference diamonds have been processed. If the count in accumulator ACC3 does not equal zero, pointer P1 is incremented by two (Step 1218) and the next successive X coordinate value in the DIAXYS table is compensated.

After all of the observed X coordinates are compensated, the observed Y coordinate values are similarly compensated for non-registration related components of deviation. Specifically, each observed Y coordinate in sequence is multiplied by a stretch correction value factor equal to the ratio of the expected Y coordinate of the second reference diamond divided by the observed Y coordinate. Specifically, by way of initialization, the following steps occur: the address of the expected Y coordinate of the first non-reference diamond (DIAXYS (3)) is loaded into pointer P1; the observed Y coordinate of the second reference diamond (REF2Y from ROM 150) is loaded into accumulator ACC5; and the diamonds processed count in ACC3 is restored to the number of non-referenced diamonds (DIACOUNT minus 2) (Step 1220).

The Y stretch correction ratio is then computed by dividing the expected second reference diamond Y coordinate in accumulator ACC2 by the observed Y coordinate value in accumulator ACC5 and loaded into accumulator ACC5 (Step 1222). The DIAXYS entries corresponding to each non-reference diamond are then accessed in sequence and the Y coordinate value multiplied by the compensation factor contained in accumulator ACC5 (Steps 1224, 1226).

After the center X Y coordinates have been normalized and compensated for non-registration related deviations, the observed diamond positions are correlated with the expected values (Step 522) and the registration error is determined by subtracting from the observed coordinates the expected coordinates of the correlating diamonds (Step 524). However, the observed coordinates must each be correlated with a particular set of expected coordinates to be compared against. To facilitate this correlation, array CXLMN contains an entry for each non-reference diamond, including four sequential words indicative of the minimum X, maximum X, minimum Y and maximum Y values that can be observed and still correlate to that particular diamond. The expected coordinates of the center of the individual non-reference diamonds are contained in array COLXYS in ROM 150; a two-word data entry X, Y, is provided for each non-reference diamond.

Figure 13:
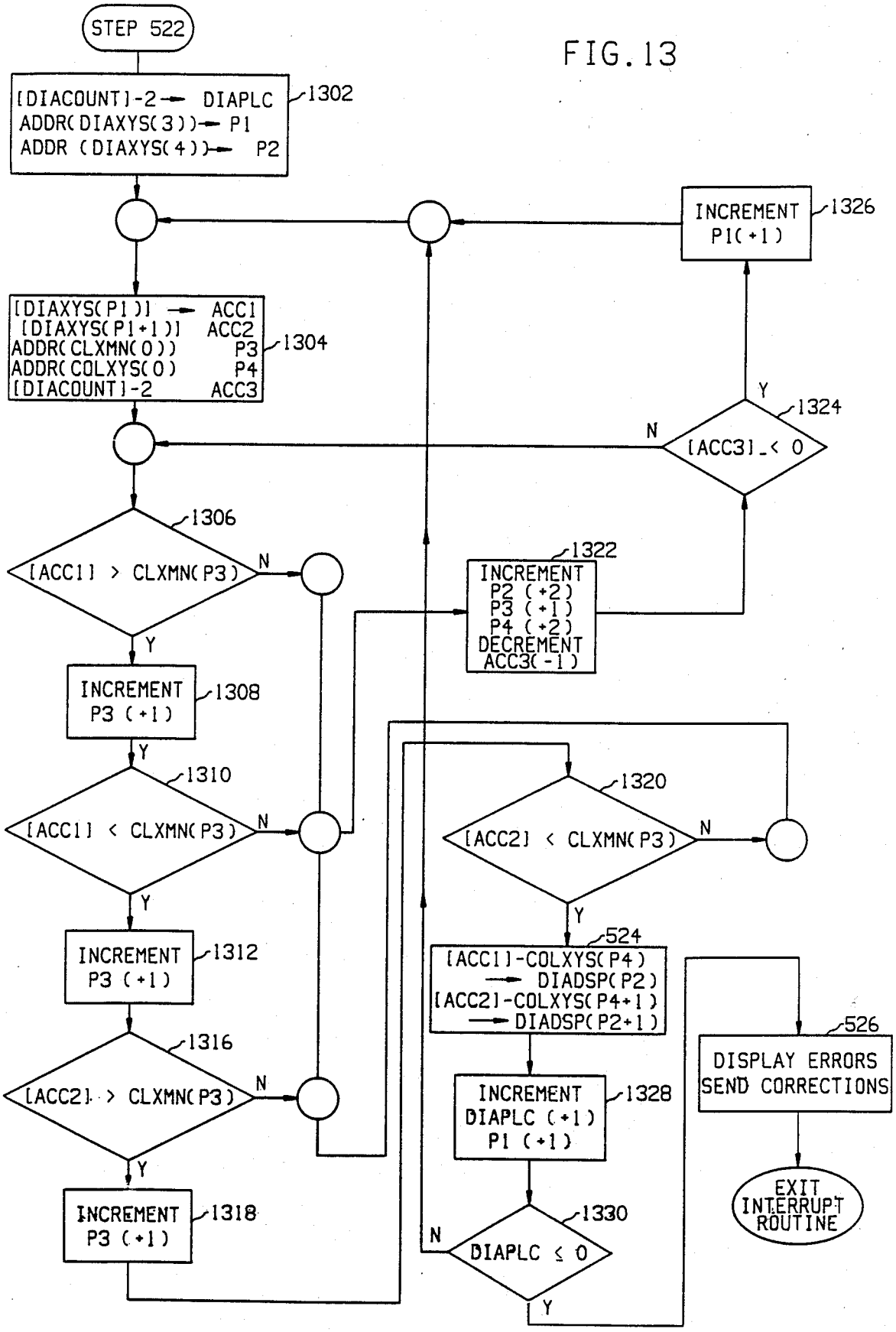
FIG. 13 is a flow chart of the process for correlating observed positions with expected values.

Referring to FIG. 13, an initialization step (Step 1302) is first effected as follows: the number of non-reference diamonds (the contents of DIACOUNT−2) is loaded into diamond placed (DIAPLC) register 368 in RAM 152; the address of coordinate of the first non-reference diamond (DIAXYS (3)) is loaded into pointer P1; and the address of the first open location (DIADSP(4)) in diamond displayed (DIADSP) table 180 is loaded into pointer P2.

The entries in DIAXYS table 178 corresponding to non-reference diamonds are, in sequence, compared to respective minimum and maximum X and Y values relating to the expected positions of the individual non-reference diamonds contained in array CXLMN in ROM 150.

The observed X coordinate in the DIAXYS location designated by pointer P1 is loaded into accumulator ACC1, the Y coordinate in the next successive location of the DIAXYS table 178 is loaded into accumulator ACC2, and the number of non-reference diamonds (DIACOUNT minus two) is loaded into accumulator ACC3.

The address of the first word in the CLXMN array (CLXMN(0)) in ROM 150 is loaded into pointer P3, and the address of the corresponding COLXYS entry (COLXYS (0)) is loaded into pointer P4 (Step 1304).

The X value in accumulator ACC1 is then compared against the minimum X value from the CLXMN location identified by pointer P3. If the X value is sufficiently large, pointer P3 is incremented by one to designate the corresponding X maximum value associated with the expected diamond (Step 1308) and a comparison is effected (Step 1310).

Assuming that the observed X coordinate of the DIAXYS entry is within limits, pointer P3 is then incremented by one to designate the CLXMN location containing the corresponding minimum Y value (Step 1312) and the observed Y value in accumulator ACC2 is compared to the minimum value (Step 1316). Assuming the observed Y coordinate passes the minimum test, pointer P3 is incremented (Step 1318) to designate the corresponding Y maximum value in array CLXMN (Step 1320).

If either the observed X or Y coordinate is found to be outside of permissible limits, the following sequence occurs: pointer P2 is incremented by two to designate the locations in the DIAPLC table corresponding to the next expected diamond; pointer P3 is incremented by one to designate the minimum X value of the next expected diamond in the CLXMN array; pointer P4 is incremented by two to designate the entry in the array COLXYS corresponding to the next expected diamond (Step 1322); and accumulator ACC3 is decremented by one.

The contents of accumulator ACC3 are then tested to determine if the CLXMN array has been exhausted (Step 1324) and, if not, the observed values in accumulators ACC1 and ACC2 compared against the next set of values in array CLXMN. If the CLXMN array is exhausted, pointer P1 is incremented by one (Step 1326) and the comparison procedure repeated with respect to the X, Y coordinates of the next observed diamond in DIAXYS table 178.

If the observed values of the X, Y coordinates are within a particular set of limits, the observed diamond is deemed to correlate to the expected center coordinate of the corresponding entry in COLXYS, and registry error is calculated by determining the deviation of the relative position of the marks from the expected position and comparing the observed X and Y coordinate with those expected center coordinates. Specifically, the corresponding expected X coordinate in array COLXYS (CLOXYS (P4)) is subtracted from the X value in the accumulator ACC1, and the result loaded into the corresponding DIADSP location (DIADSP (P2)). The expected Y value in the next successive location of the COLXYS array is subtracted from the observed Y value in accumulator ACC2 and the result located into the next successive location of DIADSP (Step 524).

Pointer P1 is incremented by one to access the next set of observed coordinates and the DIAPLC register 168 is incremented by one (Step 1328). The contents of DIAPLC are then tested against zero to determine if all the diamonds have been processed (Step 1330).

At this point, DIAPLC table 180 contains, in the locations corresponding to each of the non-reference printing units, entries indicative of the registry error between that unit and the reference unit. Corrective error signals are then generated in accordance with the registry error as required for the particular printing unit, as is known in the art (Step 526).

It will be understood that, while various of the conductors/connections are shown in the drawing as single lines, they are not so shown in a limiting sense, and may comprise plural conductors/connections as understood in the art. Further, the above description is of a preferred exemplary embodiment of the present invention, and the invention is not limited to the specific forms shown. Modifications may be made in the design and arrangement of the elements without departing from the spirit of the invention as expressed in the appended claims.

I claim:

1. A system for generating indicia of registration error between respective, separately adjustable printing units of a printing press, said printing units cooperating to print an image on a moving web, said image including at least one registration mark printed by each of said printing units, said registration marks being of predetermined shape and, when said printing units are registry, having a predetermined relative disposition on said web, the system being of the type comprising photo-optical means, having a field of view, for generating output signals indicative of markings on said web passing through said field of view in predetermined relation to said photo-optical means as said web moves in relation to said printing units, and processing means, responsive to said photo-optical means output signals, for generating signals indicative of deviations of the registration marks printed by said printing units from said predetermined relative disposition; improved wherein:

said photo-optical means has a field of view comprising a plurality of nominal cells, and comprises means for generating signals indicative of markings on said web in successive scans of a predetermined number of respective cells disposed along a line transverse to the direction of web movement as said web passes in predetermined relation to said photo-optical means;

said registration marks being disposed on said web to come within said predetermined number of cells and darkening a plurality of said cells during a plurality of said scans; and said processing means includes means for determining the cells which said registration marks darken in said successive scans.

2. The system of claim 1, wherein said registration marks are of a shape symmetrical about an axis parallel to the direction of web movement.

3. The system of claim 1, wherein said registration marks are in the shape of right-angle diamonds.

4. The system of claim 1, wherein said registration marks include a leading portion having symmetrical peripheral contours diverging from an axis parallel to the direction of web.

5. The system of claim 4, wherein said registration marks include a trailing portion having symmetrical peripheral contours converging toward said axis.

6. The system of claim 1, wherein said registration marks include a trailing portion having symmetrical peripheral contours converging toward an axis parallel to the direction of web movement.

7. The system of claim 1 wherein said processing means includes means for determining the centers of said registration marks.

8. The system of claim 3 wherein said processing means includes means for determining the centers of said right-angle diamonds.

9. A system for maintaining registry between a plurality of printing units cooperating with a moving web, said system being of the type wherein said printing units include means for placing respective registration marks on the web, the relative positions of said marks being indicative of registry between said printing units, and including means, responsive to control signals applied thereto, for adjusting the registry of said printing units, and means for generating control signals to said means for adjusting in accordance with the relative positions of said registration marks, improved wherein:

said registration marks include a portion having symmetrical sides diagonal to the direction of the web motion; and said means for generating control signals comprises means for determining, from said symmetrical sides, a respective point associated with each of said registration marks.

10. The system of claim 9, wherein said registration marks include leading and trailing portions having symmetrical sides diagonal to the direction of web motion.

11. The system of claim 10, wherein said mark leading portion sides diverge and said trailing portion sides converge.

12. The system of claim 9, wherein said registration marks are diamond-shaped.

13. The system of claim 9, wherein said means for generating control signals includes means for generating indicia of transitions in brightness level of nominal pixels along successive lines transverse to the direction of said web movement.

14. The system of claim 13, wherein said means for generating control signals further includes:

means, responsive to said indicia of transitions, for generating indicia of the relative position coordinates of said registration marks; and means for comparing said position coordinates to predetermine expected values and generating said control signals in accordance with deviations of said position coordinates from said expected values.

15. The system of claim 13, wherein:

said means for generating indicia of transitions includes:

optical line scanner means for generating image signals indicative of the brightness level in successive pixels, said successive pixels disposed transversely of the direction of movement of said web; and comparator means, responsive to said image signals, for comparing said pixel brightness levels to reference signal and generating a light/dark signal characterizing said pixels as light or dark.

16. The system of claim 14, wherein said means for generating indicia of relative position coordinates comprises:

means for generating, for each of said successive lines of pixel, indicia of the distance between transitions in said line, and the center point between said transitions;

means for identifying pairs of transitions associated with individual registration marks;

means for generating, from said transition pairs associated with said individual mark, indicia of the nominal center coordinates of each of said individual marks; and means for normalizing said nominal center coordinates to the coordinates of a predetermined one of said individual marks to provide indicia of the relative coordinates of the registration marks.

17. The system of claim 16 further including means for adjusting said nominal center coordinates for non-registry related deviation.

18. The system of claim 9 wherein said point associated with said registration mark is located at the center of said mark.

19. The system of claim 12 wherein said means for generating said control signals comprises means for determining the tips of registration marks.

20. A system for maintaining registry between a plurality of printing units cooperating with a moving web, said system being of the type wherein said printing units include means for placing respective registration marks on the web, the relative positions of said marks being indicative of registry between said printing units, and including means responsive to control signals applied thereto for adjusting the registry of said printing units, and means for generating control signals to said means for adjusting in accordance with the relative positions of said registration marks; improved wherein said means for generating control signals includes:

line scanning means for generating signals indicative of brightness level in respective nominal pixels disposed along a line extending transverse to the direction of web movement;

means, cooperating with said line scanning means, for determining, for successive scans of said line, the relative positions of transitions in brightness level along said line;

means for identifying transitions in brightness level associated with individual ones of said registration marks;

means for determining, for each mark, from transitions associated with said mark, the position of said mark relative to the other marks;

means for determining, for each mark, deviation of the relative position of said mark from a predetermined expected position; and means for generating said control signals in accordance with said deviations.

21. The system of claim 20, wherein said means for determining the position of said mark comprises means for determining the center of an area defined by the transitions associated with said mark.

22. The system of claim 21, wherein said mark is symmetrical with respect to an axis parallel to the direction of movement of said web.

23. The system of claim 20 wherein said line scanning means comprises:

a charge-coupled line image scanner;

means for controllably driving said scanner; and an analog-to-digital converter, responsive to signals from said scanner, for generating digital signals indicative of the brightness level in said respective pixels.

24. The system of claim 23 wherein said means for controllably driving said scanner comprises:

transfer pulse sychronization means, responsive to a start-scan control signal and clock signals applied thereto, for initiating operation of said scanner in sychronism with said clock signal.

25. The system of claim 20 wherein said means for determining the relative positions of transitions comprises:

means for generating a dark level reference signal indicative of ambient light level;

a comparator, receptive of said signals indicative of brightness level, and said brightness level reference signal, and generating indicia of a light or a dark brightness level in said respective pixels; and means, responsive to said indicia of a light or a dark brightness level in said pixels, for detecting transitions from light to dark and from dark to light between successive ones of said pixels.

26. The system of claim 25 wherein said means for determining the relative positions of transitions further comprises:

means, responsive to detection of said transitions, for storing indicia of the particular pixel at which the transition occurred, indicia of whether the transition is from light to dark or from dark to light, and for storing indicia of the end of said line.

27. The system of claim 25 wherein said means for generating a dark level reference signal comprises:

means for generating indicia of respective dark level references for respective groups of pixels corresponding to ambient light levels at the locations of said respective groups of pixels.

28. A method for maintaining registry between a plurality of rotating cylinders cooperating with a moving web, comprising the steps of:

placing on said web a respective registration mark of predetermined size and shape for each of said cylinders, the relative positions of said marks being indicative of the relative cyclical and transverse position of said cylinder with respect to the others of said cylinders;

generating signals indicative of the position of transitions in brightness level of a predetermined portion of said web along successive lines transverse to the direction of movement of the web;

determining, from the positions of said transitions, the relative position of said marks; and adjusting the cylinders in accordance with deviations in the relative positions of said marks from predetermined values.

29. The method of claim 28 wherein said marks are symmetrical about an axis generally parallel to the direction of web movement and said determining relative position step comprises:

determining the distance between transitions along said lines, and the center point between said transitions;

identifying pairs of transitions associated with individual marks;

determining for each individual mark, from said pairs of transitions associated with the mark, nominal coordinates of the center point of said mark;

normalizing the center point coordinates of said marks with respect to a predetermined one of said marks; and comparing the normalized center point coordinates to predetermined values.

30. The method of claim 28 wherein said generating signals indicative of transitions in brightness level step comprises:

sequentially scanning the brightness level of successive nominal pixels disposed along a line transverse to the direction of web movement, said web movement causing the brightness level of portions of the web along said successive lines to be detected.

31. The method of claim 30 wherein said determining the relative position step comprised:

generating, for successive scans of said pixels, indicia of the relative positions of brightness level transitions in said pixels;

correlating said transition positions with predetermined criteria to identify groups of transitions associated with the individual marks; and generating, for each group of transitions associated with an individual mark, indicia of the relative position of the group.

32. The method of claim 31 wherein said generating indicia of relative position step comprises storing the sequential number of pixels in which transitions occur.

33. The method of claim 31 where, in a nominial cartesian coordinate system, the web moves in a Y-direction, and the marks are intended to be disposed centered on the Y-axis, the marks are in the shape of symmetrical diamonds, and said correlating step comprises the steps of:

storing indicia of an X reference value and a tip reference value indicative of the expected Y coordinate of one of the tips of said diamond;

For successive lines:

(a) determining the X coordinate of the center point between respective sequential transitions in said line;

(b) calculating, from the distance between said sequential transitions and the Y coordinate value corresponding to said line, the Y coordinates of symmetical diamonds defined by said sequential transitions;

(c) correlating said X coordinate with said reference X value and at least one of said calculated tip Y coordinates with said tip reference value; and (d) upon favorable correlating, storing indicia of X coordinate and at least one of said calculated tip Y coordinates; and calculating, from said stored calculated tip Y coordinates, the average tip Y coordinate.

34. The method of claim 31 wherein said determining the relative position step comprises the steps of:

storing indicia of the relative location along said line of the pixels in which transitions occur;

determining the number of pixels between sequential transitions and the relative location along said line of the pixel centrally located between said sequential transitions.

35. The method of claim 28 wherein determining the relative position step comprises:

correlating said transition positions with predetermined criteria to identify a respective group of transitions associated with individual marks; and generating, for each group of transitions associated with an individual mark, indicia of the relative position of the group.

36. The method of claim 28 wherein said determining the relative position of said marks step comprises determining the center of said marks.

37. The method of claim 29 further including the step of:

adjusting said center point nominal coordinates for non-registry related positional deviations.

38. The method of claim 37 wherein said placing on said web step comprises:

placing on said web in predetermined relative position at least two of reference marks for a least one of said cylinders;

comparing the relative position of said reference marks to predetermined values to determine non-registration-related positional deviations.

39. A system for maintaining registry between a plurality of printing units cooperating with a moving web, said system being of the type wherein:

said printing units include means for placing respective registration marks on the web, said marks intended to be placed generally centered on an expected centerline, the relative positions of said marks being indicative of registry between said printing units; and including means, responsive to control signals applied thereto, for adjusting the registry of said printing units, and means for generating said control signals to said means for adjusting in accordance with the relative positions of said registration marks; improved wherein:

said registration marks are of a shape symmetrical about an axis parallel to the direction of web movement; and said means for generating said control signals includes means for detecting image densities in a predetermined area of said web generally centered on said expected centerline, said area being of an extent in a direction transverse to web movement greater than the extent of said registration marks.

40. The system of claim 39 wherein said means for generating control signals further includes:

means for determining, from said image densities, the relative positions of said marks;

means for determining deviations of said relative positions from predetermined values; and means for generating said control signals in accordance with said deviations.

41. The system of claim 39 wherein:

said means for detecting image density comprises a line image scanner disposed to provide image density data from a strip of predetermined extent on said web approximately centered on said expected centerline.

42. The system of claim 41 wherein said strip is nominally divided into a predetermined number of pixels

* * * * *